US007890013B2

(12) United States Patent
Okabe

(10) Patent No.: US 7,890,013 B2
(45) Date of Patent: Feb. 15, 2011

(54) IMAGE FORMING APPARATUS

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/749,827

(22) Filed: Mar. 30, 2010

(65) Prior Publication Data

US 2010/0178076 A1 Jul. 15, 2010

Related U.S. Application Data

(63) Continuation of application No. 11/691,752, filed on Mar. 27, 2007, now Pat. No. 7,720,405.

(30) Foreign Application Priority Data

Mar. 29, 2006 (JP) ..... 2006-091956

(51) Int. Cl.
*G03G 15/00* (2006.01)

(52) U.S. Cl. ..... 399/90; 399/107; 399/111; 399/112; 399/113; 399/116; 399/119

(58) Field of Classification Search ..... 399/107, 399/111–113, 116, 119
See application file for complete search history.

(56) References Cited

U.S. PATENT DOCUMENTS 6,708,011 B2 3/2004 Nomura et al.
2007/0160380 A1 7/2007 Imaizumi et al.
2007/0160384 A1* 7/2007 Sakurai et al. ..... 399/111
2008/0159774 A1 7/2008 Tanabe et al.
2008/0159781 A1* 7/2008 Noguchi et al. ..... 399/111

FOREIGN PATENT DOCUMENTS

JP 2003015378 1/2003

* cited by examiner

*Primary Examiner*—Ryan D Walsh
(74) *Attorney, Agent, or Firm*—Banner & Witcoff, Ltd.

(57) ABSTRACT

An image forming apparatus may include an apparatus body, and a photosensitive-member unit slidably attached to the apparatus body and retaining a plurality of photosensitive members. The apparatus body includes side wall portions opposing each other with a unit receiving section sandwiched therebetween, and a plurality of apparatus-body-side electrode members provided on the side wall portions, and each urged inward in an opposing direction of the side wall portions. The photosensitive-member unit includes a plurality of unit-side electrode members each protruding outward in the opposite direction and a guide path comprising a flat surface formed in a flat shape so that each of the apparatus-body-side electrode members slidably contacts to the flat surface during attachment of the photosensitive-member unit with respect to the unit receiving section, and that each of the apparatus-body-side electrode members slidably contacted maintains a constant inward and outward position in the opposite direction.

11 Claims, 17 Drawing Sheets

IMAGE FORMING APPARATUS

CROSS REFERENCE TO RELATED APPLICATIONS

This application is a continuation of prior U.S. application Ser. No. 11/691,752, filed Mar. 27, 2007, which claims priority benefits on the basis of Japanese Patent Application No. 2006-91956 filed on Mar. 29, 2006, the disclosures of which are incorporated herein by reference.

BACKGROUND OF THE INVENTION

1. Field

Aspects of the present invention relate to an image forming apparatus, such as a color laser printer.

2. Description of the Related Art

There has been proposed some color image forming apparatus in which four photosensitive members, corona chargers provided around the respective photosensitive members, and a cleaning device are provided as an integral photosensitive member cartridge that can be detached by withdrawal from or attached to the apparatus body, and in which developing devices that are provided for the photosensitive members can be attached to and detached from the photosensitive member cartridge.

In some color image forming apparatus, corresponding to each color, an electrode for applying high voltage on a discharge wire of a scorotron, an electrode for applying high voltage on a grid of the scorotron, an electrode for applying developing bias voltage on a developing roller, and an electrode for applying developing feed bias voltage on a feed roller are provided on the side surface of a photosensitive member cartridge frame.

However, in the photosensitive member cartridge described above, the electrodes do not protrude from one side surface of the frame. Therefore, the apparatus body side electrodes corresponding to photosensitive member cartridge side electrodes need to be retreatable. That is, it is necessary to constitute the apparatus body side electrodes such that they advance after the attachment of the photosensitive member cartridge and retreat during the detachment thereof. Thus, the apparatus configuration becomes complicated.

On the other hand, if the electrodes protrude from the side surface of the frame, the need of such configuration that the apparatus body side electrodes are retreatable as described above is eliminated. However, during the attachment/detachment of the photosensitive member cartridge to/from the apparatus body, the respective electrodes on the photosensitive member cartridge side interfere with the other electrodes on the apparatus body side, which can cause damages and connection failures in the electrodes. It is an object of the present invention to provide an image forming apparatus capable of securely connecting unit-side electrode members with apparatus-body-side electrode members in a simple construction.

SUMMARY

One aspect of the present invention may provide an image forming apparatus including an apparatus body, and a photosensitive-member unit slidably attached to and detached from the apparatus body and retaining a plurality of photosensitive members, wherein the apparatus body includes side wall portions opposing each other with a unit receiving section for removably receiving the photosensitive-member unit sandwiched therebetween, and a plurality of apparatus-body-side electrode members provided on the side wall portions, corresponding to the plurality of photosensitive members, and each urged inward in an opposing direction of the side wall portions, and the photosensitive-member unit includes a plurality of unit-side electrode members corresponding to the plurality of apparatus-body-side electrode members, respectively, connected to the respective apparatus-body-side electrode members in a state where the photosensitive-member unit is mounted in the unit receiving section, and protruding outward in the opposite direction and a guide path including a flat surface formed in a flat shape so that each of the apparatus-body-side electrode members slidably contacts to the flat surface during attachment and detachment of the photosensitive-member unit with respect to the unit receiving section, and that each of the apparatus-body-side electrode members slidably contacted maintains a constant inward and outward position in the opposed direction.

DETAILED DESCRIPTION OF PREFERRED EMBODIMENTS

1. General Structure of Color Laser Printer

Figure 1:
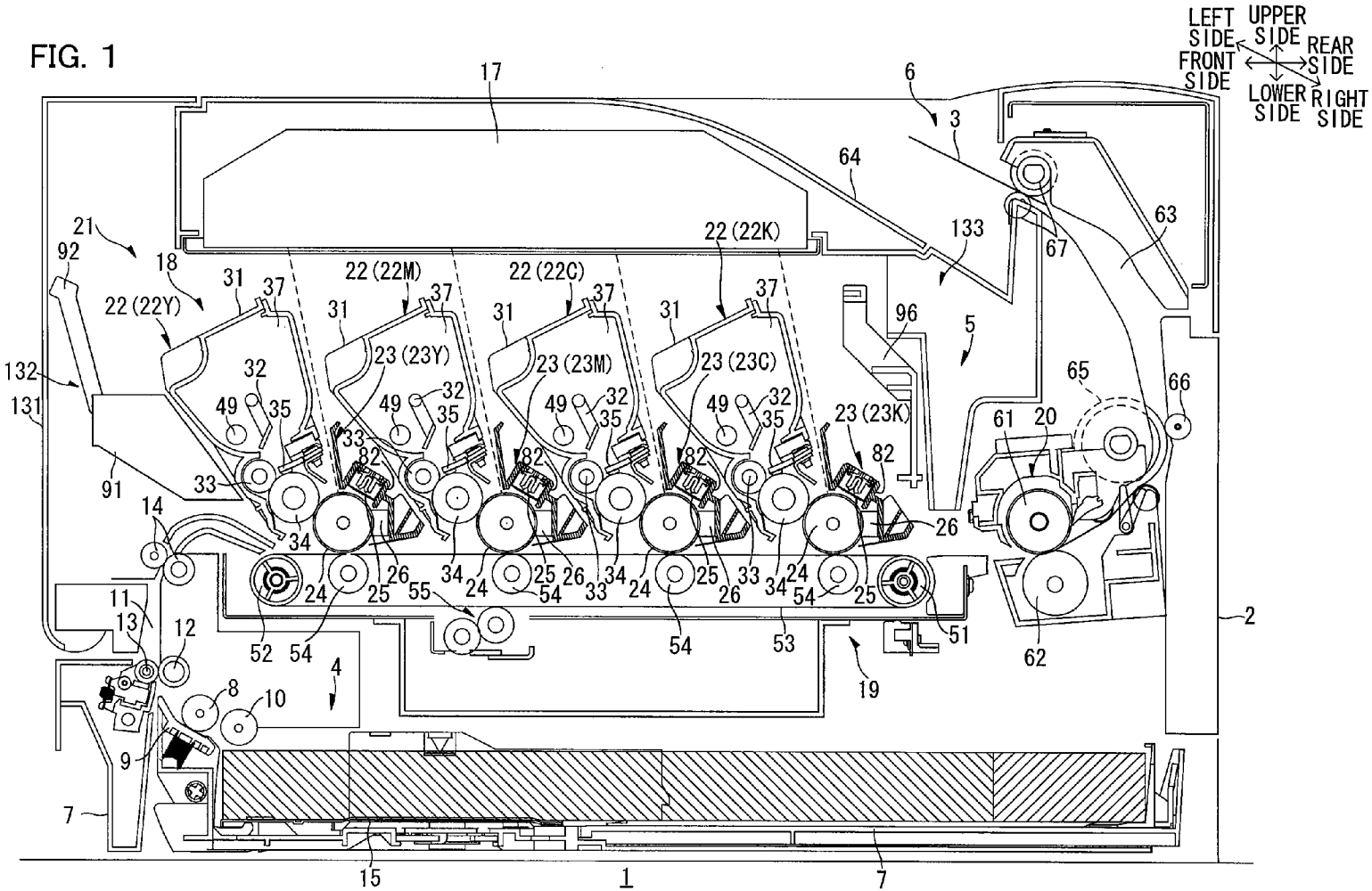
FIG. 1 is a side sectional view of the main portion of one embodiment of a color laser printer serving as the image forming apparatus of one or more aspects of the present invention.
Figure 2:
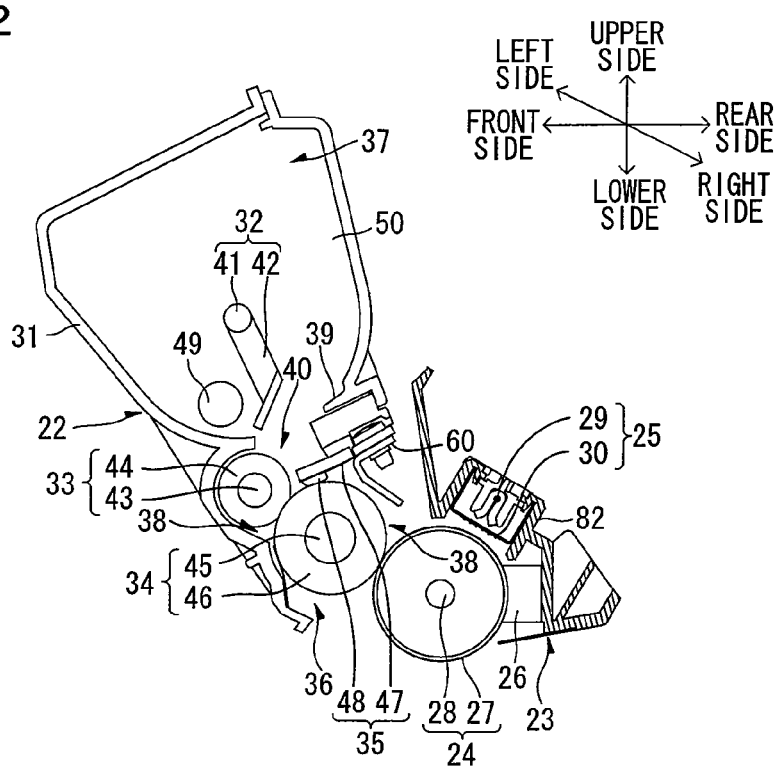
FIG. 2 is a side sectional view of the main portion of a drum subunit mounted with a developer cartridge of the color laser printer shown in FIG. 1.
Figure 3:
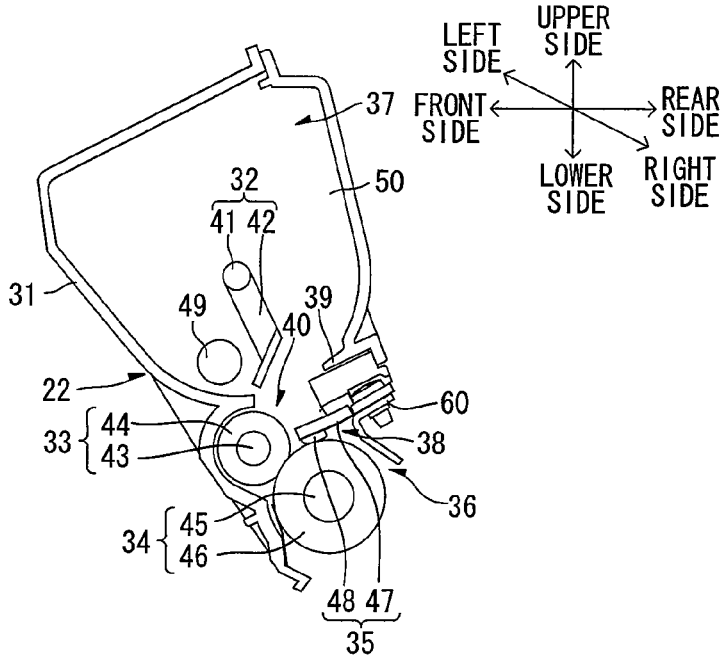
FIG. 3 is a side sectional view of the main portion of the developer cartridge shown in FIG. 2.

FIG. 1 is a side sectional view of the main portion of one embodiment of a color laser printer serving as an image forming apparatus of one or more aspects of the present invention; FIG. 2 is a side sectional view of the main portion of a drum subunit mounted with a developer cartridge of the color laser printer shown in FIG. 1; and FIG. 3 is a side sectional view of the main portion of the developer cartridge shown in FIG. 2.

As shown in FIG. 1, the color laser printer 1 is of a horizontal-tandem type in which a plurality of drum subunits 23 is horizontally arranged in juxtaposition. The color laser printer 1 includes a sheet feeding section 4 for feeding a sheet 3, an image forming section 5 for forming images on the sheet 3 fed by the sheet feeding section 4, and a sheet ejecting section 6 for ejecting the sheet 3 with an image formed thereon, in a main body casing 2 serving as an example of an image forming apparatus body.

In the following description, the left side of the paper plane of FIG. 1 (the side provided with a drum mounting port 132 in the main body casing 2) will be referred to as the front side, while the right side thereof will be referred to as the rear side. Further, the near side in the paper thickness direction of the FIG. 1 will be referred to as the right side, while the far side therein will be referred to as the left side.

A direction described below will be referred to as the direction in the state where a drum unit 21 and a developer cartridge 22 are mounted in the main body casing 2, unless otherwise noted.

(1) Sheet Feeding Section

The sheet feeding section 4 is anteroposteriorly slidably mounted in or removed from the main body casing 2 on the front side in the bottom section of the main body casing 2. The sheet feeding section 4 includes a sheet feeding tray 7 that accommodates a sheet 3, a separation roller 8 and a separation pad 9 opposing each other above the front end portion of the sheet feeding tray 7, and a sheet feeding roller 10 provided behind the separation roller 8.

In the sheet feeding section 4, a sheet feeding transport path 11 for the sheet 3 is formed generally in a U-shape as viewed in side, with the lower side of its upstream end portion adjacent to the separation roller 8 and the upper side of its downstream end portion adjacent to a transport belt 53 (described later), so that the sheet 3 is fed forward and ejected rearward after inverted.

In the midway of the sheet feeding transport path 11, a sheet dust removing roller 12 and a pinch roller 13 are provided forward above the separation roller 8 in opposed relation to each other, and a pair of resist rollers 14 are provided above these rollers.

The sheet feeding tray 7 is provided in its interior with a sheet pressing plate 15 on which sheets 3 are placed in a stacked manner, and an uppermost sheet 3 placed thereon is pressed against the sheet feeding roller 10, the rotation of which feeds the sheet 3 toward between the separation roller 8 and the separation pad 9.

The sheet 3 thus fed is sandwiched between the separation roller 8 and the separation pad 9, and is then separated and transported one by one by the rotation of the separation roller 8. The sheet 3 thus transported passes through between the sheet dust removing roller 12 and the pinch rollers 13, so that sheet dust is removed from the sheet. Thereafter, the sheet 3 is transported along the sheet feeding transport path 11 toward the resist rollers 14.

After adjusting the registration of the sheet 3, the resist rollers 14 transport the sheet 3 onto the transport belt 53.

(2) Image Forming Section

The image forming section 5 includes a scanning section 17, a processing section 18, a transferring section 19, and a fixing section 20.

(2-1) Scanning Section

A single scanning section 17 is provided in the upper portion of the main body casing 2, and includes a laser emitting section, a polygonal mirror, and a plurality of lenses and reflecting mirrors, although these components are not shown. The scanning section 17 scans a laser beam emitted from the laser emitting section based on image data for each color with the polygonal mirror, allows the laser beam thus scanned to pass through or to be reflected by the plurality of lenses and the reflecting mirrors, and thereafter, emits the laser beam to each photosensitive drum 24 corresponding to each color.

(2-2) Processing Section

The processing section 18 is arranged below the scanning section 17 and above the sheet feeding section 4. As will be described in detail later, the processing section 18 includes the single drum unit 21 serving as an example of a photosensitive-member unit, and the four developer cartridges 22 corresponding to respective colors.

(2-2-1) Drum Unit

As will be described later in detail, the drum unit 21 is removably received in a drum receiving section 133 serving as an example of a unit receiving section of the main body casing 2 and is mounted/removed on the front side thereof in the front and rear direction (the horizontal direction; the front and rear direction and the mounting direction are hereinafter explained as the same direction; the front side is equivalent to the upstream side in the mounting direction, and the rear side is equivalent to the downstream side in the mounting direction).

The drum unit 21 includes the four drum subunits 23 corresponding to respective colors. Specifically, the four drum subunits 23 are yellow, magenta, cyan, and black drum subunits 23Y, 23M, 23C, and 23K.

The drum subunits 23 are arranged in juxtaposition and anteroposteriorly spaced apart from one another. More specifically, the yellow drum subunit 23Y, the magenta drum subunit 23M, the cyan drum subunit 23C and the black drum subunit 23K are arranged in this order, from the front side to the rear side.

Each drum subunit 23 includes a pair of side frames 81 (see FIG. 5) and a center frame 82 extended between the pair of side frames 81.

As shown in FIG. 2, each drum subunit 23 retains the photosensitive drum 24 as an example of a photosensitive member, a scorotron charger 25, and a cleaning brush 26.

The photosensitive drum 24 is arranged in the width direction (the right and left direction orthogonal to the front and rear direction and to the up and down direction, the same applies in the following description), and includes a drum body 27 having a cylindrical shape formed of a positively charged photosensitive layer with an outermost surface layer of polycarbonate, and a drum shaft 28 arranged along the rotation axial direction (the width direction) of the drum body 27.

The opposite axial end portions of the drum shaft 28 are inserted through the side frames 81 (see FIG. 5) and positioned by the side plates 101 described later (see FIG. 4). The drum shaft 28 is grounded by contacting the side plates 101 (see FIG. 4).

Rotation support members (not shown) are relatively unrotatably fitted into opposite axial end portions of the drum body 27, and are relatively rotatably supported around the drum shaft 27. Thus, the drum body 27 is rotatably supported with respect to the drum shaft 28. During an image forming operation, a driving force from a motor (not shown) provided in the main body casing 2 is transmitted to the photosensitive drum 24, so that the photosensitive drum 24 is rotated.

The scorotron charger 25 is arranged obliquely rearward above the photosensitive drum 24 so as to be spaced in opposed relation thereto, while being retained by the center frame 82. The scorotron charger 25 includes a discharge wire 29 spaced in opposed relation to the photosensitive drum 24, and a grid 30 provided between the discharge wire 29 and the photosensitive drum 24.

A wire electrode 85 (see FIG. 6) serving as an example of a unit-side electrode member described later is connected to the discharge wire 29, and a grid electrode 86 (see FIG. 6) serving as an example of a unit-side electrode member described later is connected to the grid 30. In the scorotron charger 25, during an image forming operation, a discharge voltage is applied to the discharge wire 29 via the wire electrode 85 from a wire contact portion 137 (see FIG. 15) as an example of an apparatus-body-side electrode member described later provided in the main body casing 2, so that corona discharge occurs in the discharge wire 29.

At the same time, a grid voltage is applied to the grid 30 via the grid electrode 86 from a grid contact portion 138 (see FIG. 15) as an example of an apparatus-body-side electrode member described later provided in the main body casing 2, so that the surface of the photosensitive drum 24 is charged with a uniformly positive polarity while the amount of charge supplied to the photosensitive drum 24 is controlled.

The cleaning brush 26 is arranged behind the photosensitive drum 24 so as to be in contact with the photosensitive drum 24, and is retained by the center frame 82. A cleaning electrode 88 (see FIG. 6) as an example of a unit-side electrode member described later is connected to the cleaning brush 26. During an image forming operation, a cleaning bias is applied to the cleaning brush 26 via the cleaning electrode 88 (see FIG. 6) described later from a cleaning contact portion 139 (see FIG. 5) as an example of an apparatus-body-side electrode member described later provided in the main body casing 2.

(2-2-2) Developer Cartridge

As shown in FIG. 1, the developer cartridges 22 are detachably provided corresponding to the drum subunits 23 for the respective colors. That is, there are four developer cartridges 22 including yellow, magenta, cyan, and black developer cartridges 22Y, 22M, 22C, and 22K that are removably mounted in the yellow, magenta, cyan, and black drum subunits 23Y, 23M, 23C, and 23K, respectively.

As shown in FIG. 3, each of the developer cartridges 22 includes a developer frame 31, and an agitator 32, a feed roller 33, a developing roller 34 and a layer-thickness regulating blade 35 which are provided in the developer frame 31.

The developer frame 31 is formed in a box-like shape with an opening 36 opened at a lower end portion thereof, and is divided into a toner accommodation chamber 37 and a developing chamber 38 by a partition wall 39 formed midway in the up and down direction. The partition wall 39 has a communication port 40 that allows the toner accommodation chamber 37 to communicate with the developing chamber 38.

The toner accommodation chamber 37 accommodates a toner of each color. More specifically, the toner accommodation chamber 37 accommodates a yellow, magenta, cyan, or black toner in a corresponding yellow, magenta, cyan, or black developer cartridge 22Y, 22M, 22C, or 22K.

A positively-charged, non-magnetic, single-component polymer toner containing a coloring agent of yellow, magenta, cyan, or black that is mixed corresponding to each color is used as the toner of each color.

The toner accommodation chamber 37 is provided with windows 49 for detecting the amount of toner remaining therein. The windows 49 are embedded in both side walls 50 (see FIG. 5) of the developer frame 31 and oppose to each other with the toner accommodation chamber 37 sandwiched therebetween.

The agitator 32 is provided in the toner accommodation chamber 37. The agitator 32 includes a rotating shaft 41 that is rotatably supported on the both side walls 50 of the developer frame 31, and an agitating member 42 that is provided on the agitator rotating shaft 41 along the axial direction thereof while extending outward in the radial direction from the rotating shaft 41.

During an image forming operation, a driving force from a motor (not shown) provided in the main body casing 2 is inputted to the agitator rotating shaft 41, so that the agitating member 42 circularly moves in the toner accommodation chamber 37.

The feed roller 33 is provided below the communication port 40 in the developing chamber 38. The feed roller 33 includes a metal feed roller shaft 43 that is rotatably supported on the both side walls 50 of the developer frame 31, and a sponge roller 44 made of electrically-conductive sponge that covers the feed roller shaft 43.

During an image forming operation, a driving force from a motor (not shown) provided in the main body casing 2 is inputted to the feed roller shaft 43, so that the feed roller 33 is rotated.

The developing roller 34 is provided obliquely rearward below the feed roller 33 in the developing chamber 38. The developing roller 34 includes a metal developing roller shaft 45 that is rotatably supported on the both side walls 50 of the developer frame 31, and a rubber roller 46 made of electrically-conductive rubber that covers the developing roller shaft 45.

The developing roller shaft 45 is provided so that it's opposite axial end portions protrude from the both side walls 50 of the developer frame 31 toward both widthwise sides. Each axial end portion of the developing roller shaft 45 is covered with an electrically-conductive collar member 68 (see FIG. 5). A developing roller electrode 87 (see FIG. 6) as an example of a unit-side electrode member described later is connected to the collar member 68 via an electrically-conductive relay member (not shown) provided on the side wall 50 of the developer cartridge 31.

The developing roller 34 is arranged with respect to the feed roller 33 so that the rubber roller 46 and the sponge roller 44 are in pressure-contact with each other. The developing roller 34 is also arranged so as to be exposed downward from the opening 36 of the developing chamber 38.

In the developing roller 34, during an image forming operation, a driving force from a motor (not shown) provided in the main body casing 2 is inputted to the developing roller shaft 45, so that the developing roller 34 is rotated. A developing bias is applied to the developing roller shaft 45 via a developing roller contact portion 136 (see FIG. 15) as an example of an apparatus-body-side electrode member described later provided in the main body casing 2.

The layer-thickness regulating blade 35 is provided in the developing chamber 38 so as to pressure-contact the developing roller 34 from above. The layer-thickness regulating blade 35 includes a blade 47 formed of a metal leaf-spring member, and a pressing member 48 having a semicircular section made of insulating silicone rubber and provided in the distal end portion of the blade 47.

The proximal edge of the blade 47 is fixed to the partition wall 39 by a fixing member 60. An elastic force of the blade 47 brings the pressing member 48 provided in the distal end portion of the blade 47 into pressure-contact with the rubber roller 46 of the developing roller 34 from above.

(2-2-3) Developing Operation in Processing Section

In each developer cartridge 22, a toner of each color accommodated in the toner accommodation chamber 37 moves to the communication port 40 by its own weight, and is then discharged from the communication port 40 to the developing chamber 38 while being agitated by the agitator 32.

The toner discharged from the communication port 40 to the developing chamber 38 is then supplied to the feed roller 33. By rotation of the feed roller 33, the toner supplied to the feed roller 33 is supplied to the developing roller 34. At this time, the toner is triboelectrically charged with a positive polarity between the feed roller 33 and the developing roller 34 to which a developing bias is applied.

Then, the toner supplied to the developing roller 34 enters between the pressing member 48 of the layer-thickness regulating blade 35 and the rubber roller 46 of the developing roller 34 along with the rotation of the developing roller 34. As a result, the toner is carried on the surface of the rubber roller 46 as a thin layer having a uniform thickness.

On the other hand, as shown in FIG. 2, in the drum subunits 23 for the respective corresponding developer cartridges 22, the scorotron charger 25 generates corona discharge to uniformly positively charge the surface of the photosensitive drum 24.

The surface of the photosensitive drum 24 is uniformly positively charged by the scorotron charger 25 as the photosensitive drum 24 rotates, and is subsequently exposed by high-speed scanning of the laser beams from the scanning section 17. Thus, an electrostatic latent image corresponding to an image to be fixed on a sheet 3 is formed.

As the photosensitive drum 24 further rotates, the developing roller 34 is subsequently brought into opposed contact with the photosensitive drum 24 along with the rotation thereof. At this time, the positively charged toner carried on the surface of the developing roller 34 is supplied to the electrostatic latent image formed on the surface of the photosensitive drum 24, that is, an exposed portion, having a lower potential due to exposure to the laser beams, on the surface of the photosensitive drum 24 which is uniformly positively charged. Thus, the electrostatic latent image thereon is transformed into a visible image due to development, whereby a toner image by reversal developing corresponding to each color is carried on the surface of the photosensitive drum 24.

(2-3) Transferring Section

As shown in FIG. 1, the transferring section 19 is anteroposteriorly arranged above the sheet feeding section 4 and below the processing section 18, in the main body casing 2. The transferring section 19 includes a driving roller 51, a driven roller 52, a transport belt 53, a transfer roller 54, and a cleaning section 55.

The driving roller 51 and the driven roller 52 are anteroposteriorly spaced in opposed relation to each other. The driving roller 51 is arranged rearward from the black drum subunit 23K, and the driven roller 52 is arranged forward from the yellow drum subunit 23Y.

The transport belt 53 is an endless belt formed of resin film such as electrically-conductive polycarbonate or polyimide in which electrically-conductive particles such as carbon are distributed. The transport belt 53 is wound between the driving roller 51 and the driven roller 52.

During an image forming operation, a driving force from a motor (not shown) provided in the main body casing 2 is inputted to the driving roller 51, so that the driving roller 51 is rotated. Then, the transport belt 53 circumferentially moves between the driving roller 51 and the driven roller 52 so as to rotate in the same direction as the rotational direction of the photosensitive drums 24 at transfer positions where the transport belt 53 is in opposed contact with the photosensitive drums 24 of the respective drum subunits 23, thereby the driven roller 52 is driven.

The transfer rollers 54 are provided inside of the transport belt 53 wound between the driving roller 51 and the driven roller 52 so as to be opposed to the photosensitive drums 24 with the transport belt 53 interposed.

Each of the transfer rollers 54 has a metal roller shaft, and a rubber roller made of electrically-conductive rubber that covers the metal roller shaft. Each of the transfer rollers 54 rotates in the same direction as the circumferential move of the transport belt 53 at transfer positions where the transfer rollers 54 are in opposed contact with the transport belt 53. During an image forming operation, a transfer bias is applied to the transfer rollers 54 from a high-voltage circuit board (not shown) provided in the main body casing 2.

The cleaning section 55 is arranged below the transport belt 53 wound between the driving roller 51 and the driven roller 52.

The sheet 3 fed from the sheet feeding section 4 is transported from the front side to the rear side by the transport belt 53 that is circumferentially moved by the driving of the driving roller 51 and the following movement of the driven roller 52 so that the sheet 3 sequentially passes through the transfer positions of the respective drum subunits 23. During the transportation, toner images of the respective colors carried on the photosensitive drums 24 in the respective drum subunits 23 are sequentially transferred onto the sheet 3, whereby a color image is formed on the sheet 3.

Specifically, for example, a yellow toner image carried on the surface of the photosensitive drum 24 of the yellow drum subunit 23Y is transferred onto a sheet 3, and subsequently, a magenta toner image carried on the surface of the photosensitive drum 24 of the magenta drum subunit 23M is transferred and overlapped onto the sheet 3 where the yellow toner image is already transferred. Then, in the same manner as above, a cyan toner image carried on the surface of the photosensitive drum 24 of the cyan drum subunit 23C, and a black toner image carried on the surface of the photosensitive drum 24 of the black drum subunit 23K are sequentially transferred and overlapped thereonto, whereby a color image is formed on the sheet 3.

On the other hand, during the transfer operation described above, the toner stuck on the surface of the transport belt 53 is removed by the cleaning section 55.

(2-4) Fixing Section

The fixing section 20 is arranged rearward from the black drum subunit 23K in the main body casing 2 so as to be anteroposteriorly opposed to the transfer positions where the photosensitive drums 24 are in contact with the transport belt 53. The fixing section 20 includes a heating roller 61 and a pressure roller 62.

The heating roller 61 has a metal pipe formed with a release layer on its surface, and a halogen lamp mounted therein along its axial direction. The halogen lamp heats the surface of the heating roller 61 to a fixing temperature.

The pressure roller 62 is arranged below the heating roller 61 in opposed relation thereto. The pressure roller 62 presses the heating roller 61 from below.

The color image transferred onto the sheet 3 is transported to the fixing section 20, and is thermally fixed onto the sheet 3 while the sheet 3 passes between the heating roller 61 and the pressure rollers 62.

(3) Sheet Ejecting Section

In the sheet ejecting section 6, a sheet ejecting transport path 63 for sheet 3 is formed generally in a U-shape as viewed in side, with the lower side of its upstream end portion adjacent to the fixing section 20 and the upper side of its downstream end portion adjacent to a sheet ejection tray 64, so that a sheet 3 is fed rearward and ejected forward after inverted.

A transport roller 65 and a pinch roller 66 opposing each other are provided in the midway of the sheet ejecting transport path 63. A pair of sheet ejecting rollers 67 is provided in a downstream end portion of the sheet ejecting transport path 63.

The sheet ejecting section 6 is provided with the sheet ejection tray 64. The sheet ejection tray 64 is formed such that the upper wall of the main body casing 2 gradually recesses from the front side to the rear side so that the sheets 3 to be ejected can be placed in a stacked manner.

The sheet 3 transported from the fixing section 20 is transported along the sheet ejecting transport path 63 by the transport roller 65 and the pinch roller 66, and is ejected onto the sheet ejection tray 64 by the sheet ejecting roller 67.

2. Drum Unit

Figure 4:
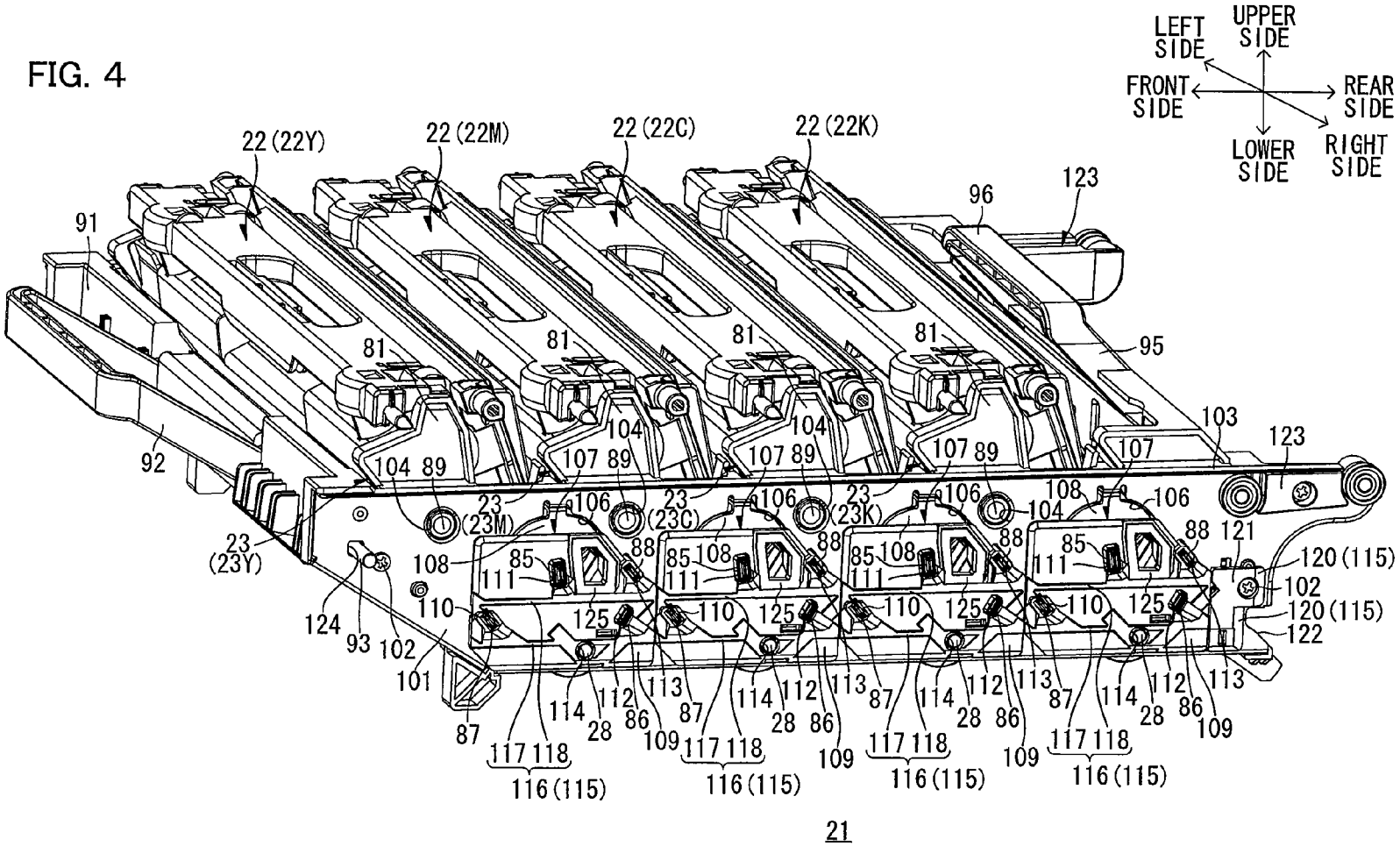
FIG. 4 is a right side perspective view of a drum unit (with a developer cartridge mounted)
Figure 5:
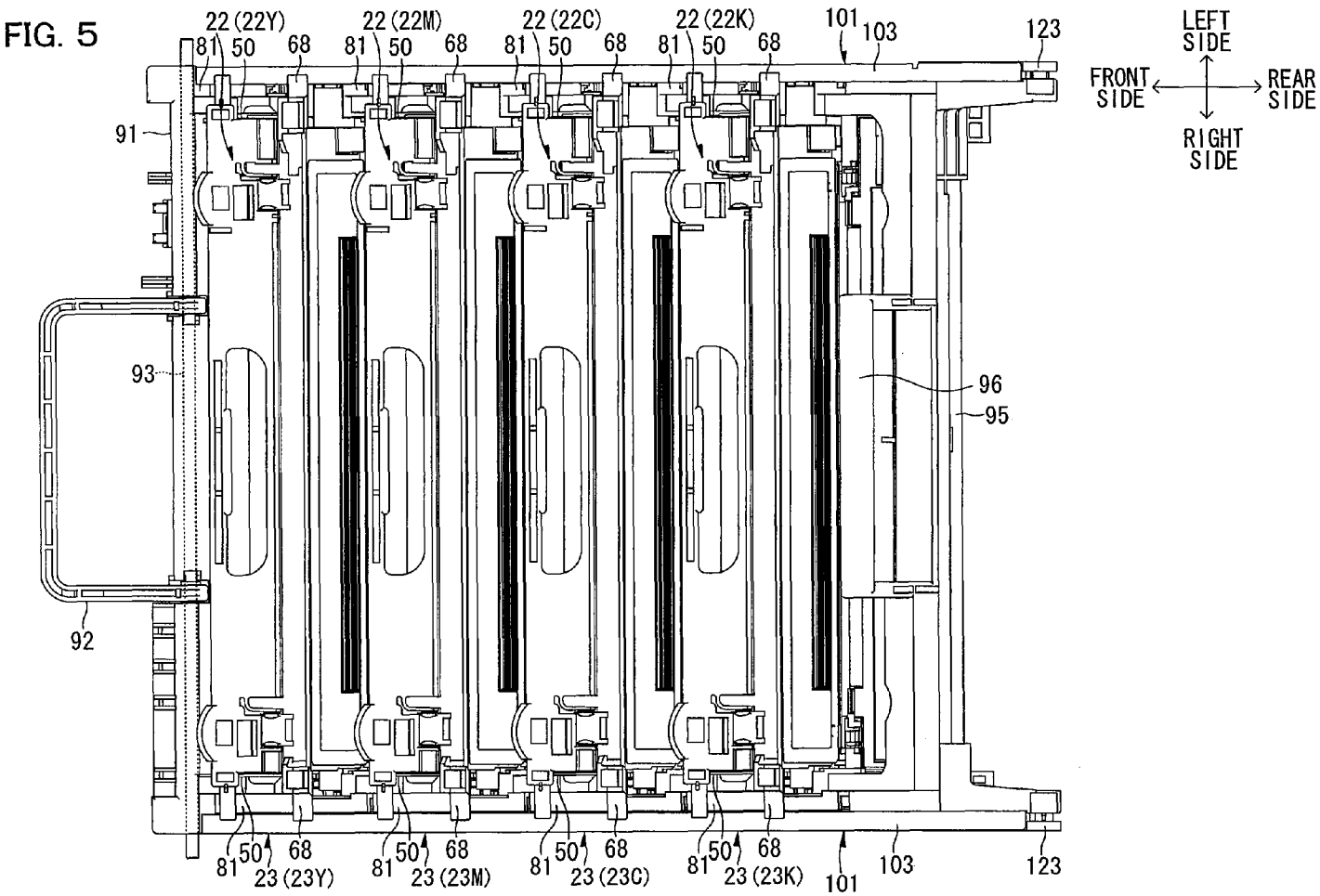
FIG. 5 is a plan view of the drum unit shown in FIG. 4.
Figure 6:
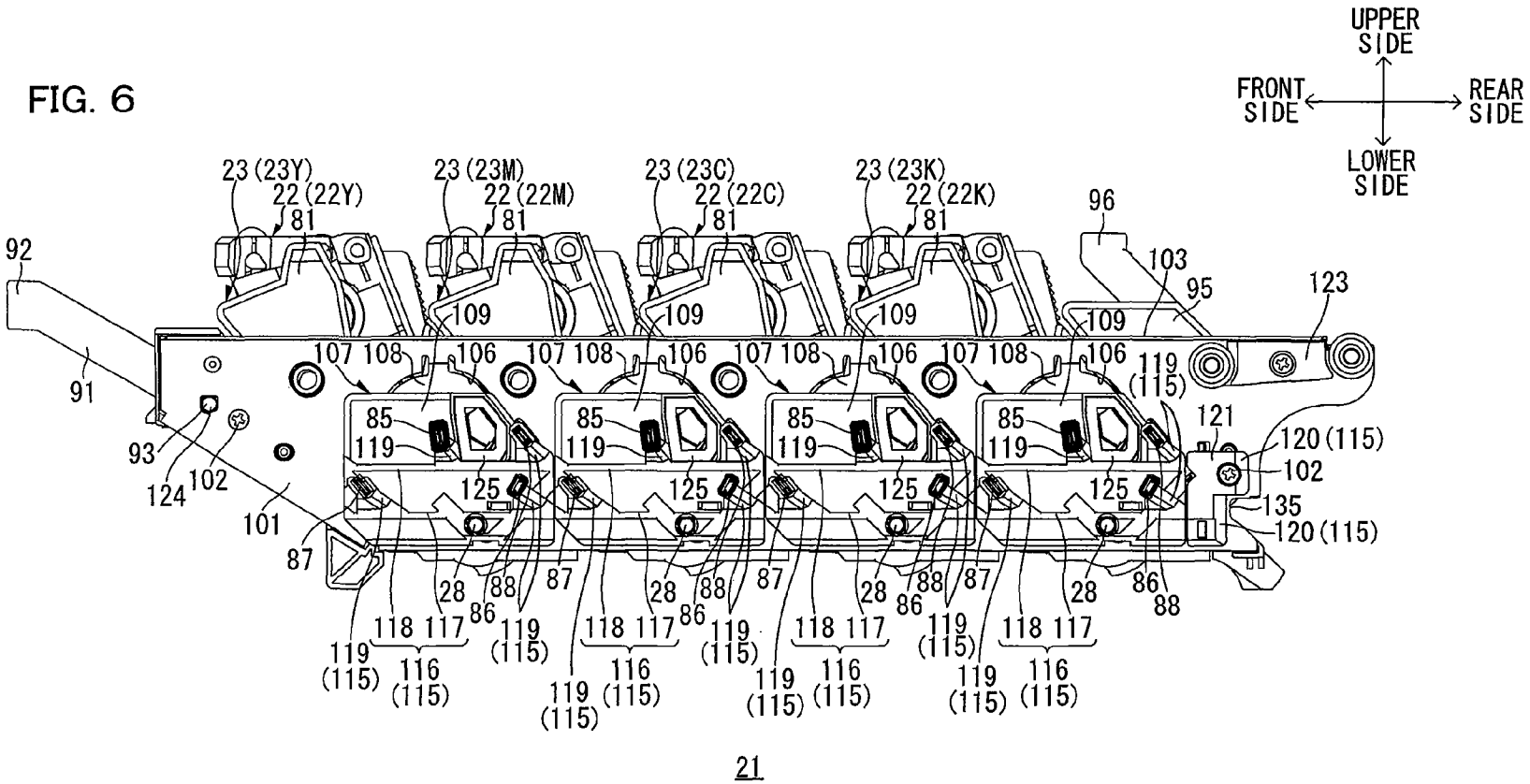
FIG. 6 is a right side view of the drum unit shown in FIG. 4.

FIG. 4 is a right side perspective view of a drum unit (with a developer cartridge mounted), FIG. 5 is a plan view of the drum unit shown in FIG. 4, and FIG. 6 is a right side view of the drum unit shown in FIG. 4.

Next, the drum unit will be described in detail with reference to FIGS. 4 through 6.

As shown in FIG. 4, the drum unit 21 includes the four drum subunits 23 corresponding to the respective colors, a front beam 91 and a rear beam 95 that are arranged on both anteroposterior sides of the four drum subunits 23 anteroposteriorly arranged in juxtaposition, and a pair of the side plates 101 (see FIG. 5) sandwiching the front beam 91, the four drum subunits 23, and the rear beam 95 therebetween in the width direction.

The drum unit 21, where the four drum subunits 23, the front beam 91, the rear beam 95, and the pair of side plates 101 are included, is slidably mounted to or removed from the drum receiving section 133 (see FIG. 1) of the main body casing 2.

(1) Drum Subunit

The drum subunit 23 is formed of resin material. As shown in FIG. 5 and described above, the drum subunit 23 includes a pair of the side frames 81 spaced in opposed relation to each other in the width direction, and the center frame 82 (see FIG. 2) extended between the pair of side frames 81 along the width direction.

As shown in FIGS. 4 and 5, each side frame 81 is formed in a flat plate shape with a guide groove (not shown) for guiding the attachment/detachment of the developer cartridge 22 to/from the drum subunit 23.

The guide groove is formed from the front upper end edge of the side frame 81 to near the rear lower end thereof along a generally up and down direction. The guide groove is provided so that its downstream end portion (the deepest portion) contacts the collar member 68 of the developing roller shaft 45 when the developing roller 34 contacts the photosensitive drum 24. The collar member 68 covering the developing roller shaft 45 is slidably received in the guide groove.

Each side frame 81 has a boss 89. The bosses 89 are each formed in a tubular shape such that the boss protrudes outward in the width direction from the side frame 81, and are arranged in opposed relation to the two windows 49 (see FIG. 2) of the developer cartridge 22 in the width direction in the state where the developer cartridge 22 is mounted in the drum subunit 23.

As described above, the drum shaft 28 of the photosensitive drum 24 is inserted through each side frame 81.

As shown in FIG. 6, the wire electrode 85, the grid electrode 86, the developing roller electrode 87, and the cleaning electrode 88 are supported so as to penetrate the right-side side frame 81 in the thickness direction while protruding outward in the width direction.

The wire electrode 85 is generally centered in the side frame 81 in the front-and-rear and up-and-down directions. The grid electrode 86 is arranged in a rear end portion of the side frame 81 at the midway of the up and down direction. The developing roller electrode 87 is arranged in a front end portion of the side frame 81 at the midway of the up and down direction. The cleaning electrode 88 is arranged in the rear end portion of the side frame 81 at the midway of the up and down direction and above the grid electrode 86.

More specifically, the wire electrode 85 and the cleaning electrode 88 are arranged on the same straight line along the front and rear direction (attachment/detachment direction). The grid electrode 86 and the developing roller electrode 87 are also arranged on the same straight line along the front and rear direction (attachment/detachment direction).

The wire electrode 85 and the cleaning electrode 88, and the grid electrode 86 and the developing roller electrode 87 are arranged in parallel to one another at intervals in the up and down direction so that the wire electrode 85 and the cleaning electrode 88 are on the upper side and the grid electrode 86 and the developing roller electrode 87 are on the lower side.

As shown in FIG. 2, the center frame 82 is extended between the pair of side frames 81 opposing each other in the width direction, and retains the scorotron charger 25 and the cleaning brush 26.

The developer cartridge 22 is removably mounted in the drum subunit 23 corresponding to each color. The developer cartridge 22 is mounted in the corresponding drum subunit 23 by inserting the collar members 68 at the both axial end portions of the developing roller shaft 45 into the respective guide grooves formed in the side frames 81 of the corresponding drum subunit 23, and sliding the collar members 68 downward along the guide grooves to abut the collar members 68 against the deepest portions of the guide grooves.

In the state where the developer cartridge 22 is mounted in the drum subunit 23, the collar member 68 at the right-side axial end portion of the developing roller shaft 45 is connected to the developing roller electrode 87 provided in the right-side side frame 81, as shown in FIG. 6, via an electrically-conductive relay member (not shown) provided in the side wall 50 of the developer cartridge 31.

(2) Front Beam

As shown in FIG. 4, the front beam 91 is integrally formed of resin material. As shown in FIG. 5, the front beam 91 is arranged in front of the four drum subunits 23 anteroposteriorly arranged in juxtaposition, and is extended between the pair of side plates 101.

As shown in FIG. 4, the front beam 91 is formed so as to incline from the lower rear side toward the upper front side in side view. As shown in FIG. 5, the front beam 91 includes a front-side grasp portion 92 attached to it's widthwise center portion and a support shaft 93 rotatably supporting the front-side grasp portion 92.

The support shaft 93 is formed of a rod shaft integrally formed, and is arranged so as to penetrate the front beam 91 along the width direction and supported by the front beam 91. The both widthwise end portions of the support shaft 93 are protruded from the front beam 91 outward in the width direction.

The front-side grasp portion 92 has a generally U-shape in plan view, with both distal end portions thereof rotatably supported by the support shaft 93 in it's widthwise center portion. As described later, the front-side grasp portion 92 is pivoted to a fall-down position (see FIG. 6) where the front-side grasp portion 92 is fallen down when a front cover 131 of the main body casing 2 is swung to an open position, and to a stand-up position (see FIG. 1) where the front-side grasp portion 92 stands up when the front cover 131 of the main body casing 2 is swung to a closed position, around the support shaft 93 as a fulcrum.

(3) Rear Beam

The rear beam 95 is integrally formed of resin material. The rear beam 95 is arranged behind the four drum subunits 23 that are anteroposteriorly arranged in juxtaposition, and is extended between the pair of side plates 101.

The rear beam 95 is formed in a generally L-shape in side view in which its upper end portion protrudes rearward as shown in FIG. 6, and in a generally flat-bottomed U-shape in plan view in which its rear portion is open as shown in FIG. 5. A back-side grasp portion 96 is integrally provided in the widthwise center portion of the rear beam 95. As shown in FIG. 4, the back-side grasp portion 96 has a generally U-shape in rear view, and both distal end portions thereof are coupled to the rear beam 95, incline from the lower rear side toward the upper front side, and protrude obliquely upward from the rear beam 95.

(4) Side Plates

As shown in FIG. 5, the side plates 101 are provided as a pair so that the front beam 91, the four drum subunits 23 and the rear beam 95 can be sandwiched therebetween from the both sides of the width direction. Each side plate 101 is formed of metal or fiber reinforced resin.

Each side plate 121 has a generally elongated rectangular plate shape as viewed in side, anteroposteriorly extended, is opposed to the front beam 91 and the rear beam 95 at its front end portion and the rear end portion, respectively, and is fixed to the front beam 91, the four drum subunits 23, and the rear beam 95 which are anteroposteriorly arranged in juxtaposition.

More specifically, the four drum subunits 23 are anteroposteriorly arranged so as to be adjacent to one another, in the state where each drum subunit 23 inclines from the upper front side to the lower rear side by bringing the front end face of the side frame 81 of the drum subunit 23 on the rear side (downstream side in the mounting direction) into abutment against the rear end face of the side frame 81 of the drum subunit 23 on the front side (upstream side in the mounting direction) in the mutually adjacent drum subunits 23. Further, while the rear end face of the front beam 91 abuts the front end face of each side frame 81 of the foremost drum subunit 23, the front end face of the rear beam 95 abuts the rear end face of each side frame 81 of the rearmost drum subunit 23.

As shown in FIG. 6, the side plates 101 are respectively fixed to the front beam 91 and the rear beam 95 with screws 102.

As a result of this fixing, the wire electrodes 85 and cleaning electrodes 88 in all the drum subunits 23 are arranged on the same straight line along the front and rear direction (attachment/detachment direction). Further, the grid electrodes 86 and developing roller electrodes 87 in all the drum subunits 23 are arranged in the same straight line along the front and rear direction (attachment/detachment direction).

All the wire electrodes 85 and cleaning electrodes 88, and all the grid electrodes 86 and developing roller electrodes 87 are arranged in parallel at intervals in the up and down direction so that all the wire electrodes 85 and cleaning electrodes 88 are on the upper side and all the grid electrodes 86 and developing roller electrodes 87 are on the lower side.

At the upper end portion of each side plate 101, the upper end edge thereof is bent outward in the width direction so as to have an L-shape as viewed in section, and a flange portion 103 extending outward in the width direction over the front and rear direction is formed. The flange portions 103 are slidably inserted into guide rails 145 (see FIG. 7) described later in the main body casing 2.

As shown in FIG. 4, each side plate 101 is provided in its upper end portion with four light passing holes 104, each receiving the boss 89 of the drum subunit 23.

The four light passing holes 104 are anteroposteriorly formed in spaced relation to one another in upper end portions of each side plate 101. Each light passing hole 104 is a round hole which penetrates the side plate 101 in the thickness direction at positions where the window 49 of the developer cartridge 22 is opposed to the boss 89 in the width direction. A boss 89 of each drum subunit 23 is fitted into each of the light passing holes 104 so that the boss is exposed outward in the width direction. Thus, the pivot of each drum subunit 23 around the drum shaft 28 with respect to each side plate 101 is restricted.

Each side plate 101 is also provided in its lower end portion with shaft holes (not shown) that allow insertion of the axial end portions of each drum shaft 28. Four shaft holes are anteroposteriorly formed in spaced relation to one another in bottom end portion of each side plate 101. The shaft hole is a square hole which penetrates the side plate 101 in the thickness direction at the position where the axial end portion of each drum shaft 28 is opposed thereto in the width direction. Both end portions of the drum shaft 28 of the photosensitive drum 24 of each drum subunit 23 are inserted through a pair of the shaft holes opposing each other in the width direction.

At the shaft hole, the end portion of each drum shaft 28 is urged by a wire spring (not shown) to make a point-contact with the peripheral end faces of the shaft hole, thereby being positioned by the shaft hole.

Each side plate 101 is provided in its rear end portion (downstream end portion in the mounting direction) with a notched portion 122 that hold a reference shaft 135 (see FIG. 8) described later from the up and down direction in the state where the drum unit 21 is mounted in the main body casing 2. The notched portion 122 is formed in a general recess-shape that is recessed forward on the lower side of the rear end edge.

Each side plate 101 is also provided on the upper side of its rear end portion with a roller member 123 that rolls along the guide rail 145 (see FIG. 7) described later of the main body casing 2 during the attachment/detachment of the main body casing 2 to/from the drum unit 21.

Each side plate 101 is provided in its front end portion (upstream end portion in the mounting direction) with a support shaft insertion hole 124 that allows insertion of the support shaft 93. The support shaft 93 protruding outward from the front beam 91 in the width direction is inserted through the support shaft insertion hole 124 so that the support shaft 93 protrudes outward in the width direction.

(5) Right-Side Side Plate

As shown in FIG. 4, the right-side side plate 101 is provided with four electrode openings 106 each embedded with a seal member 107 made of insulating rubber material therein.

(5-1) Seal Member

Each seal member 107 is provided corresponding to each drum subunit 23, and integrally includes a fitting portion 108 that is fitted into each electrode opening 106, and a covering portion 109 provided on the widthwise outer side of the fitting portion 108 for covering the right-side side plate 101.

The fitting portion 108 has a tubular shape that corresponds to the electrode opening 106 and is embedded in the electrode opening 106.

The covering portion 109 is formed on the widthwise outer side of the fitting portion 108 in a flat plate shape covering the electrode opening 106 and the shaft hole (not shown) through which the drum shaft 28 is inserted. More specifically, as shown in FIGS. 4 and 6, the covering portion 109 is formed in a generally rectangular plate shape in which a rear upper corner portion is cut off so that, as viewed in side, its lower end edge anteroposteriorly extends along the lower end edge of the side plate 101, its upper end edge extends in parallel to the lower end edge above the wire electrode 85, its rear end edge extends along the up and down direction behind the grid electrode 86 and subsequently extends so as to incline obliquely upwardly forward from the rear side to pass through the cleaning electrode 88, and its front end edge extends in the up and down direction in front of the developing roller electrode 87.

Each covering portion 109 corresponding to each drum subunit 23 is in contact with the adjacent covering portion 109 so that the rear end edge, of the front covering portion 109, extending along the up and down direction is continuous without space with the front end edge, of the rear covering portion 109, extending along the up and down direction.

The covering portion 109 has a developing roller electrode opening 110, a wire electrode opening 111, a grid electrode opening 112, a cleaning electrode opening 113, and a shaft opening 114 for allowing exposure of the developing roller electrode 87, the wire electrode 85, the grid electrode 86, the cleaning electrode 88, and the drum shaft 28, respectively, outward in the width direction.

The developing roller electrode opening 110, the wire electrode opening 111, the grid electrode opening 112, the cleaning electrode opening 113, and the shaft opening 114 are formed so as to penetrate the covering portion 109 in the width direction, at positions where the developing roller electrode opening 110, the wire electrode opening 111, the grid electrode opening 112, the cleaning electrode opening 113, and the shaft opening 114 are opposed to the developing roller electrode 87, the wire electrode 85, the grid electrode 86, the cleaning electrode 88, and the drum shaft 28, respectively. The developing roller electrode 87, the wire electrode 85, the grid electrode 86, the cleaning electrode 88, and the drum shaft 28 penetrate the developing roller electrode opening 110, the wire electrode opening 111, the grid electrode opening 112, the cleaning electrode opening 113, and the shaft opening 114, respectively, and are exposed outward in the width direction from the seal member 107.

The covering portion 109 is provided with a seal frame portion 125 that is expanded outward in the width direction, above an upper flat surface 118 described later and between the wire electrode opening 111 and the cleaning electrode opening 113.

(5-2) Guide Path

The right-side side plate 101 is provided with a guide path 115 to which the developing roller contact portion 136, wire contact portion 137, grid contact portion 138, and cleaning contact portion 139 described later provided in the main body casing 2 slidably contact during the attachment/detachment of the drum unit 21 to/from the main body casing 2. The guide path 115 includes a flat surface 116, a guide surface 119, and a mounting guide surface 120.

The flat surface 116 is formed in a flat shape in the width direction in order to maintain the constant widthwise positions of the developing roller contact portion 136, wire contact portion 137, grid contact portion 138, and cleaning contact portion 139. The flat surface 116 includes a lower flat surface 117 to which the developing roller contact portion 136 and the grid contact portion 138 slidably contact, and the upper flat surface 118 which is arranged above the lower flat surface 117 in spaced relation and to which the wire contact portion 137 and the cleaning contact portion 139 slidably contact.

The lower flat surface 117 and the upper flat surface 118 are provided so as to anteroposteriorly extend and be parallel to each other at an interval in the up and down direction.

More specifically, the lower flat surface 117 is formed on each seal member 107 below the developing roller electrode 87 and the grid electrode 86 so as to anteroposteriorly linearly pass through a clearance in the up and down direction between the drum shaft 28, and the developing roller electrode 87 and the grid electrode 86 while being parallel to the upper end edge of the side plate 101. Between the adjacent seal members 107, the lower flat surfaces 117 are anteroposteriorly continuous without a step.

The upper flat surface 118 is formed on each seal member 107 below the wire electrode 85 and the cleaning electrode 88 so as to anteroposteriorly linearly pass through a clearance in the up and down direction between the developing roller electrode 87 and the grid electrode 86, and the wire electrode 85 and the cleaning electrode 88 while being parallel to the upper end edge of the side plate 101. Between the adjacent seal members 107, the upper flat surface 118 is anteroposteriorly continuous without a step.

The guide surfaces 119 are provided so as to respectively correspond to the developing roller electrode 87, the grid electrode 86, the wire electrode 85, and the cleaning electrode 88 in order to guide the corresponding developing roller contact portion 136, wire contact portion 137, grid contact portion 138, and cleaning contact portion 139 to the developing roller electrode 87, grid electrode 86, wire electrode 85, and cleaning electrode 88, respectively, from the flat surface 116 in each seal member 107.

Figure 10:
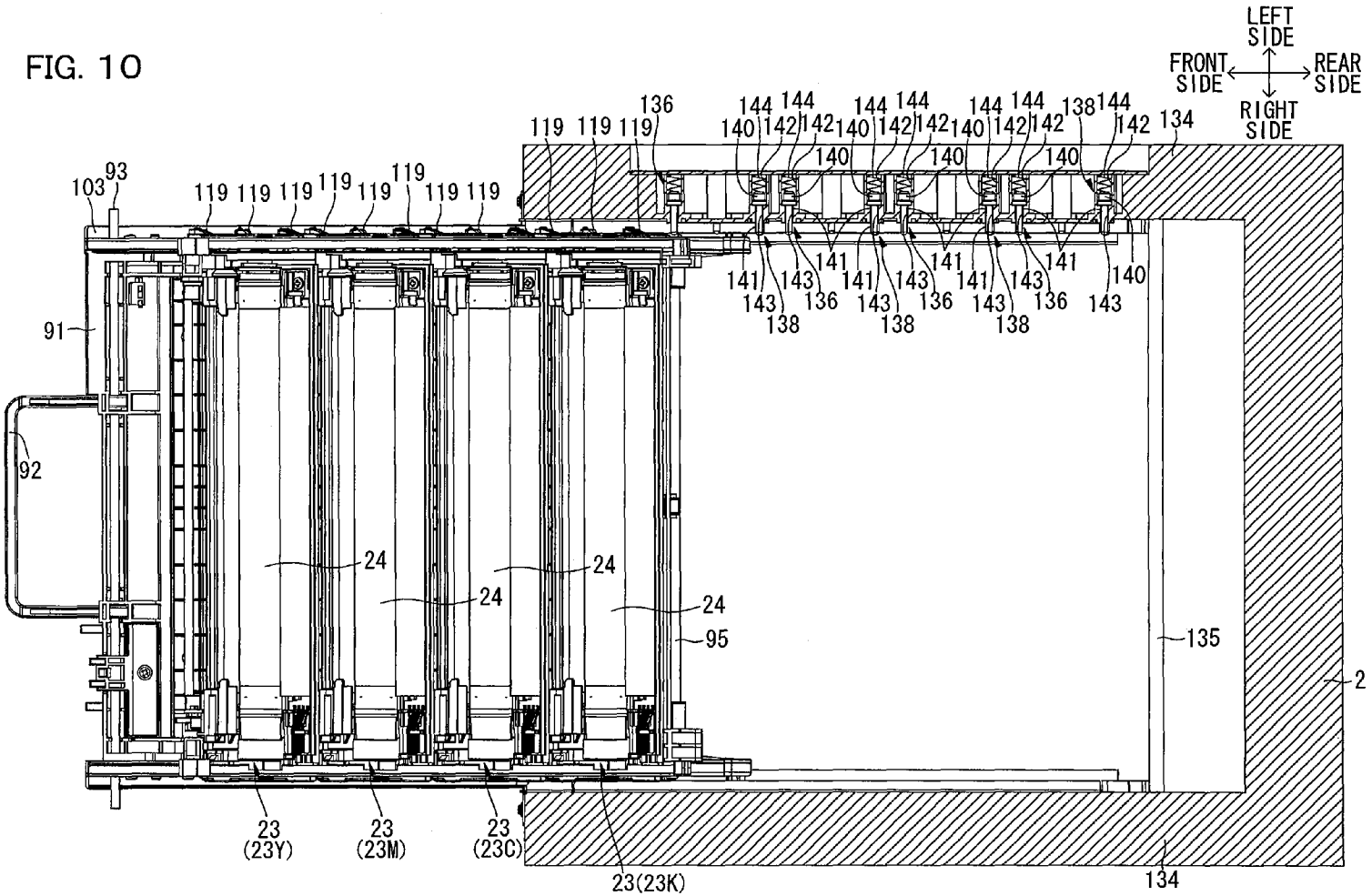
FIG. 10 is a bottom view in FIG. 7.

More specifically, the guide surface 119 corresponding to the developing roller electrode 87 is formed such that the guide surface 119 extends so as to branch from the lower flat surface 117 on the rear side (downstream side in the mounting direction) of the developing roller electrode 87 obliquely upwardly forward, and inclines (expands) forward (upstream side in the mounting direction) from the lower flat surface 117 in the outward width direction (see FIG. 10).

The guide surface 119 corresponding to the grid electrode 86 is formed such that the guide surface 119 extends so as to branch from the lower flat surface 117 on the rear side (downstream side in the mounting direction) of the grid electrode 86 obliquely upwardly forward, and inclines (expands) forward (upstream side in the mounting direction) from the lower flat surface 117 in the outward width direction (see FIG. 10).

The guide surface 119 corresponding to the wire electrode 85 is formed such that the guide surface 119 extends so as to branch from the upper flat surface 118 on the rear side (downstream side in the mounting direction) of the wire electrode 85 obliquely upwardly forward, and inclines (expands) forward (upstream side in the mounting direction) from the upper flat surface 118 in the outward width direction (see FIG. 10).

The guide surface 119 corresponding to the cleaning electrode 88 is formed such that the guide surface 119 extends so as to branch from the upper flat surface 118 on the rear side (downstream side in the mounting direction) of the cleaning electrode 88 obliquely upwardly forward, and inclines (expands) forward (upstream side in the mounting direction) from the upper flat surface 118 in the outward width direction (see FIG. 10).

The mounting guide surface 120 is formed on a mounting guide plate 121 in a rear end portion of the right-side side plate 101. That is, the mounting guide plate 121 is a thin plate in an inverted L-shape as viewed in side, and is screwed to a position which is a rear end portion (most downstream side in the mounting direction) of the right-side side plate 101 and the front side of the notched portion 122.

The mounting guide surface 120 is formed in a rear end portion of the mounting guide plate 121. More specifically, the mounting guide surface 120 is formed in a two-step shape with its upper portion arranged rearward and its lower portion arranged forward of its upper portion, as an inclined surface where both of its upper and lower portions incline from the rear side to the front side and from the widthwise inner side to the widthwise outer side (see FIG. 9).

The mounting guide plate 121 is flush with the flat surface 116 in the width direction, and its front end edge is anteroposteriorly continuous with the rear end edge of the rearmost seal member 107 without a step.

3. Main Body Casing

Figure 7:
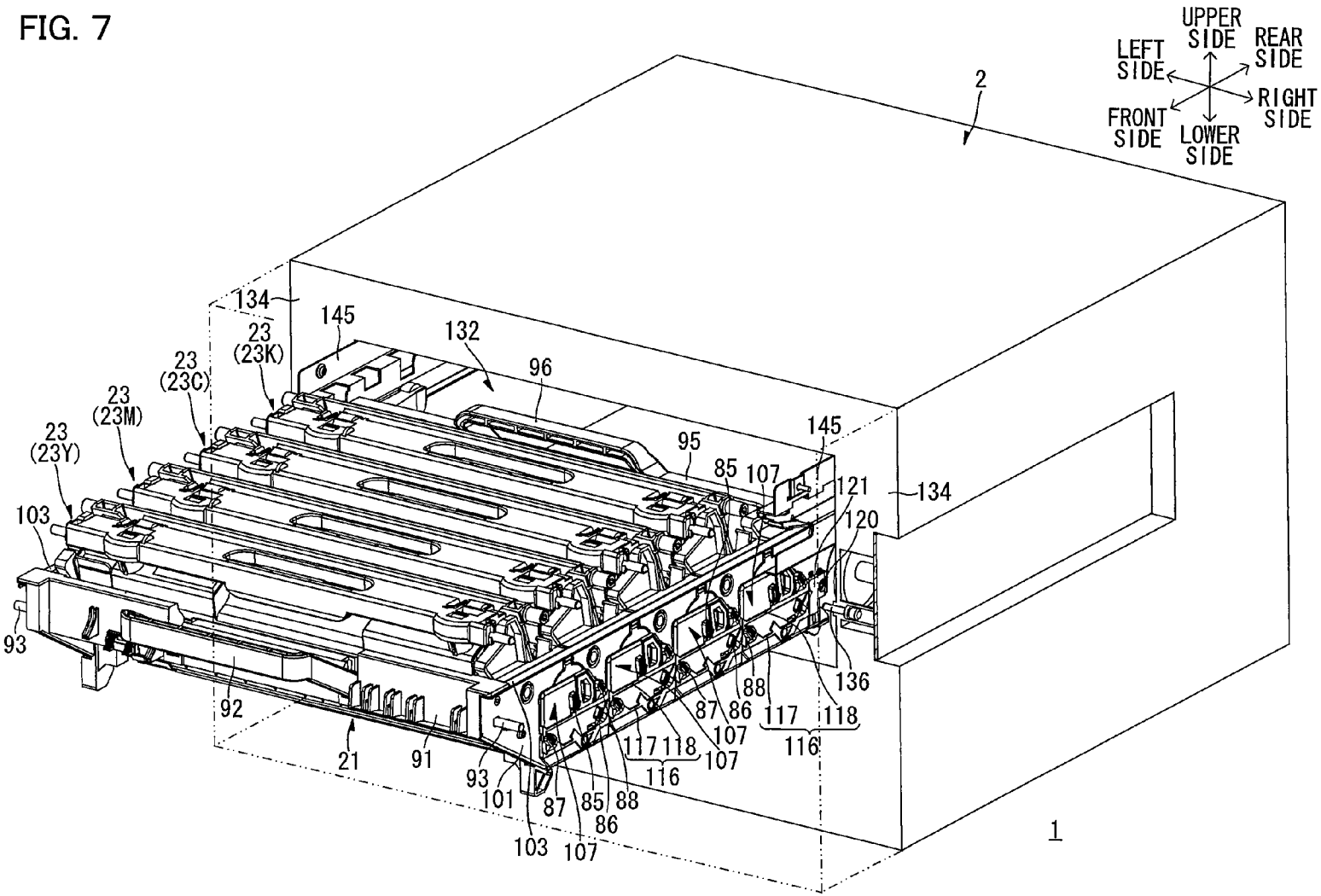
FIG. 7 is a perspective view showing a state in which the drum unit is mounted to a main body casing (the state after the start of mounting of the drum unit)
Figure 8:
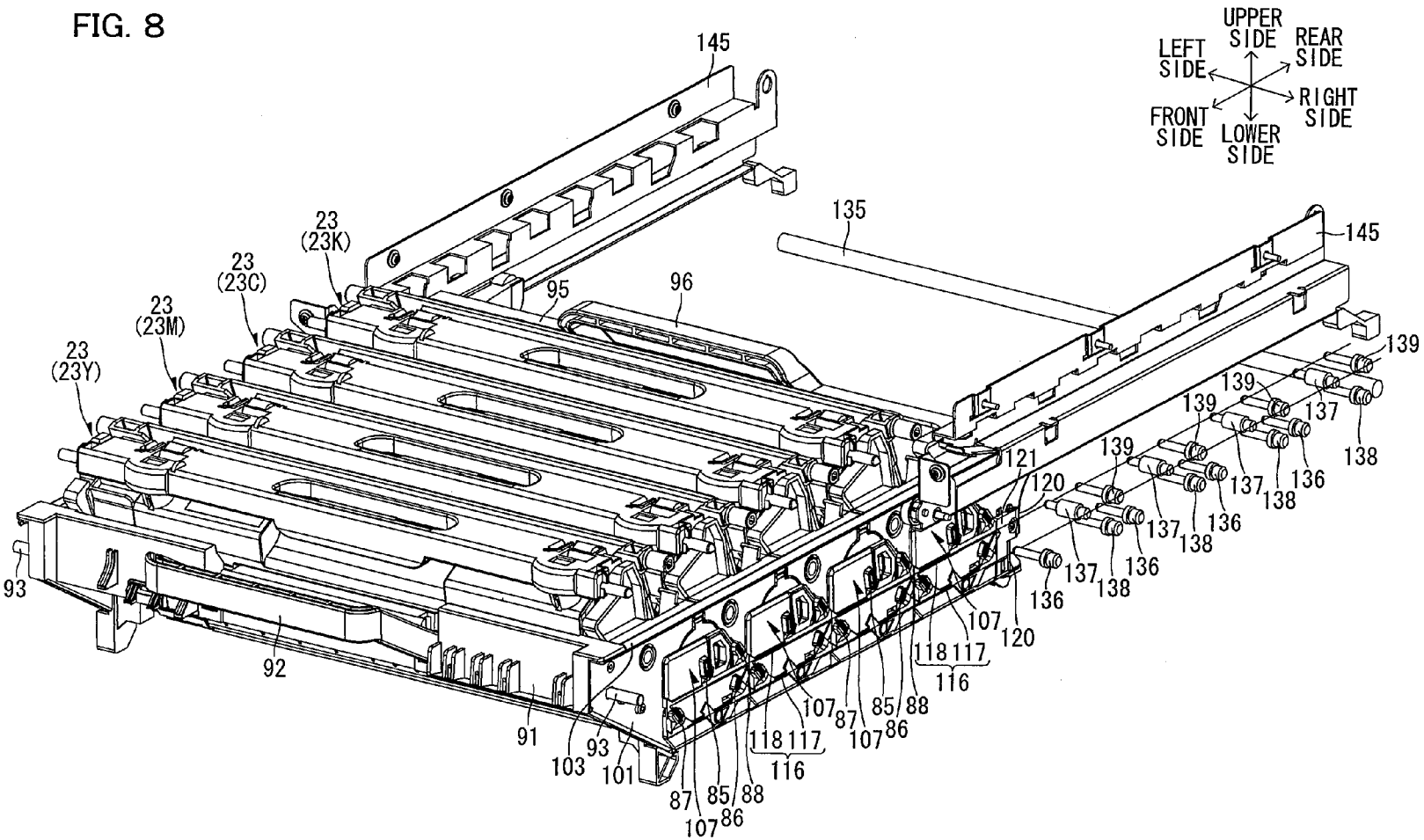
FIG. 8 is a perspective view of the main portion in FIG. 7.
Figure 9:
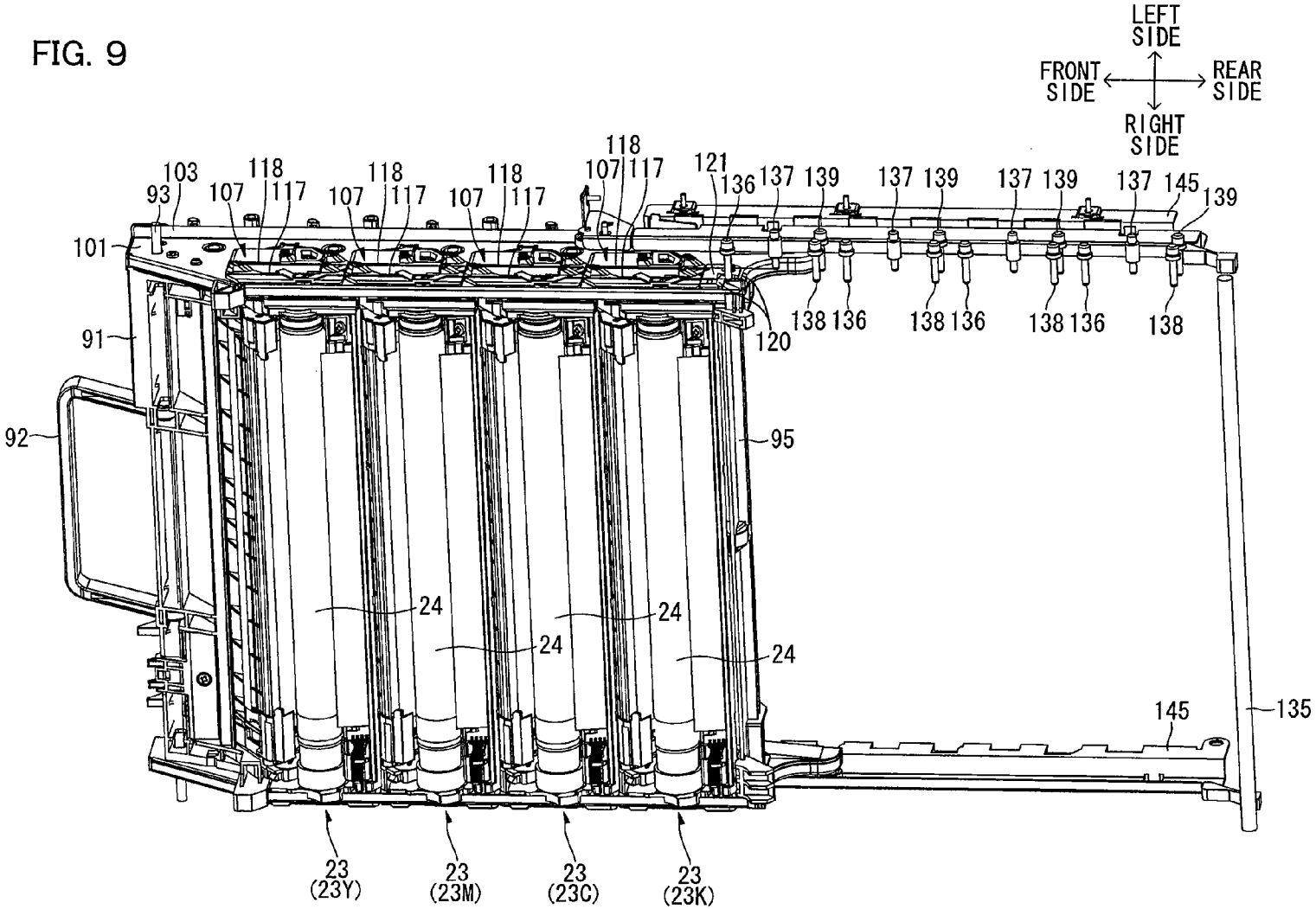
FIG. 9 is a bottom view of the main portion in FIG. 7.
Figure 11:
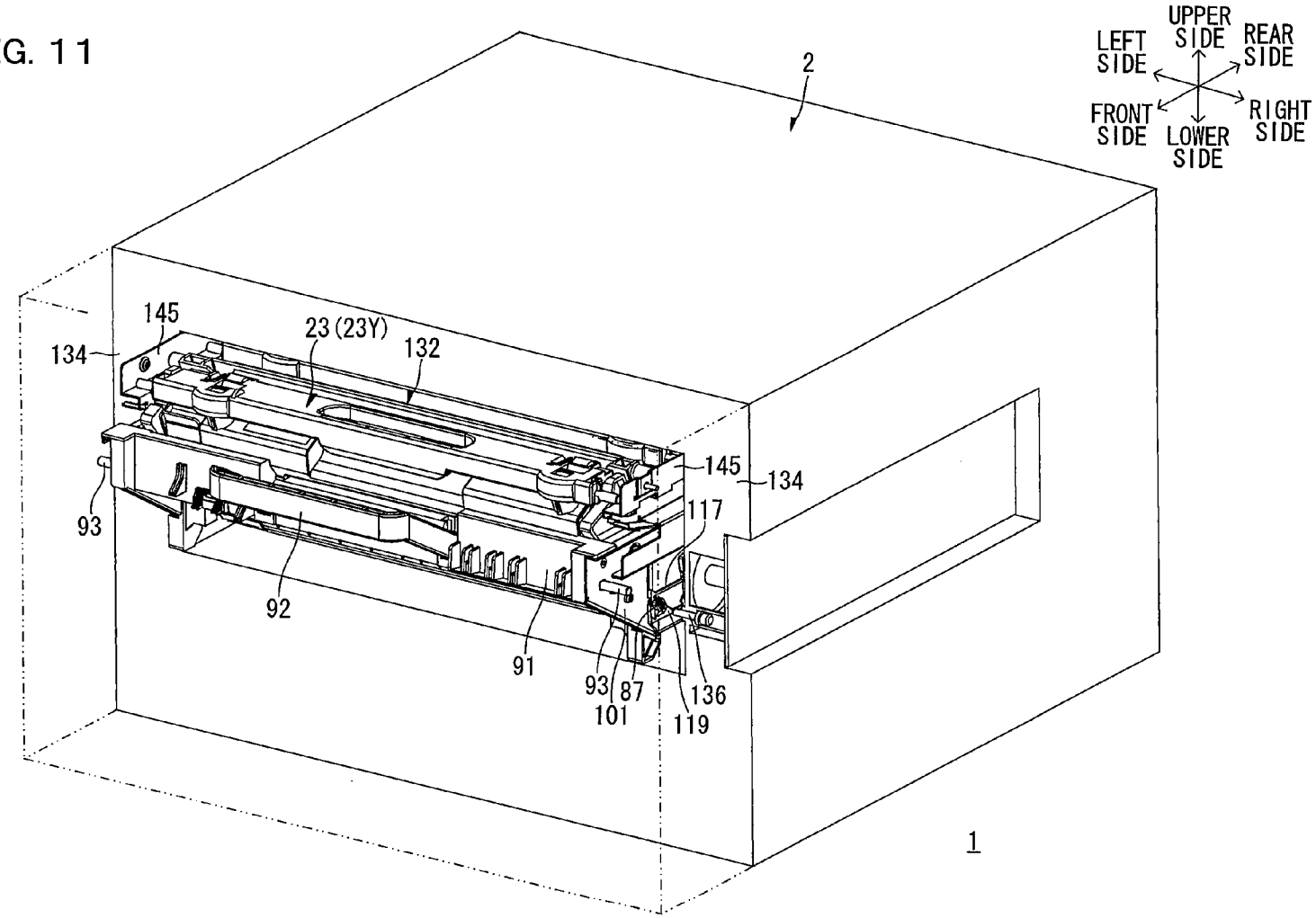
FIG. 11 is a perspective view showing a state in which a drum unit is mounted to a main body casing (the state before the completion of mounting of the drum unit)
Figure 12:
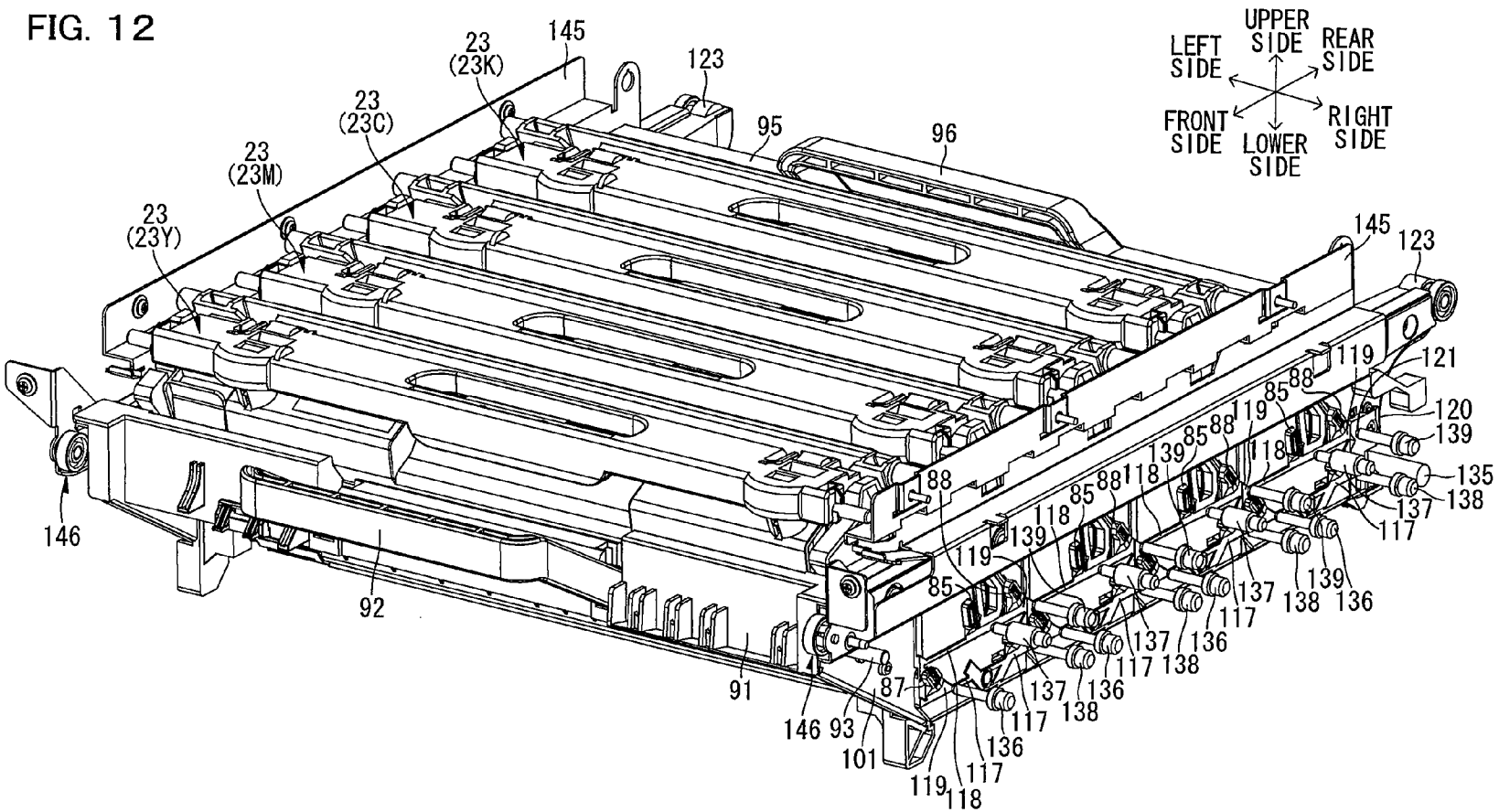
FIG. 12 is a perspective view of the main portion in FIG. 11.
Figure 13:
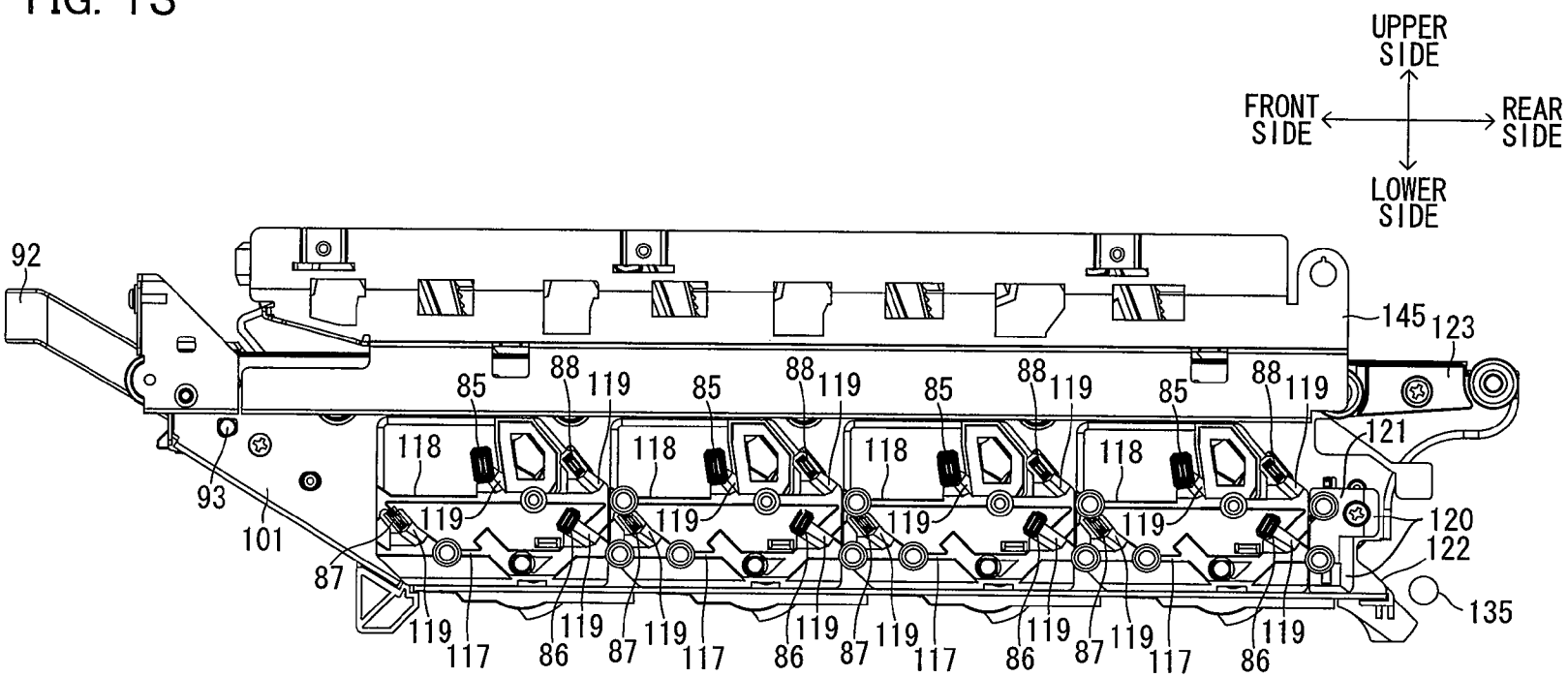
FIG. 13 is a right side view in FIG. 11.
Figure 14:
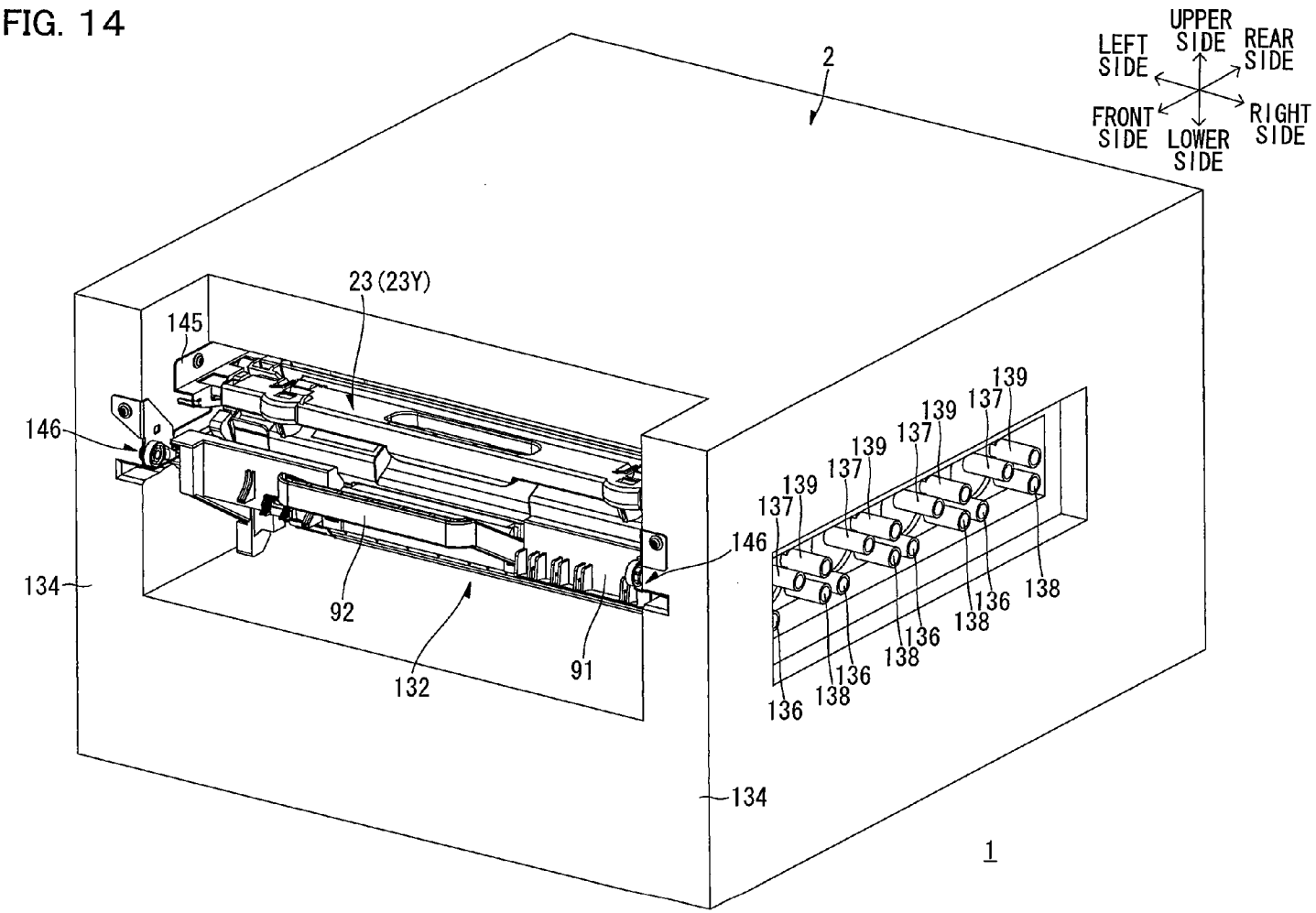
FIG. 14 is a perspective view showing a state in which a drum unit is mounted to a main body casing (the state after the completion of mounting of the drum unit)
Figure 15:
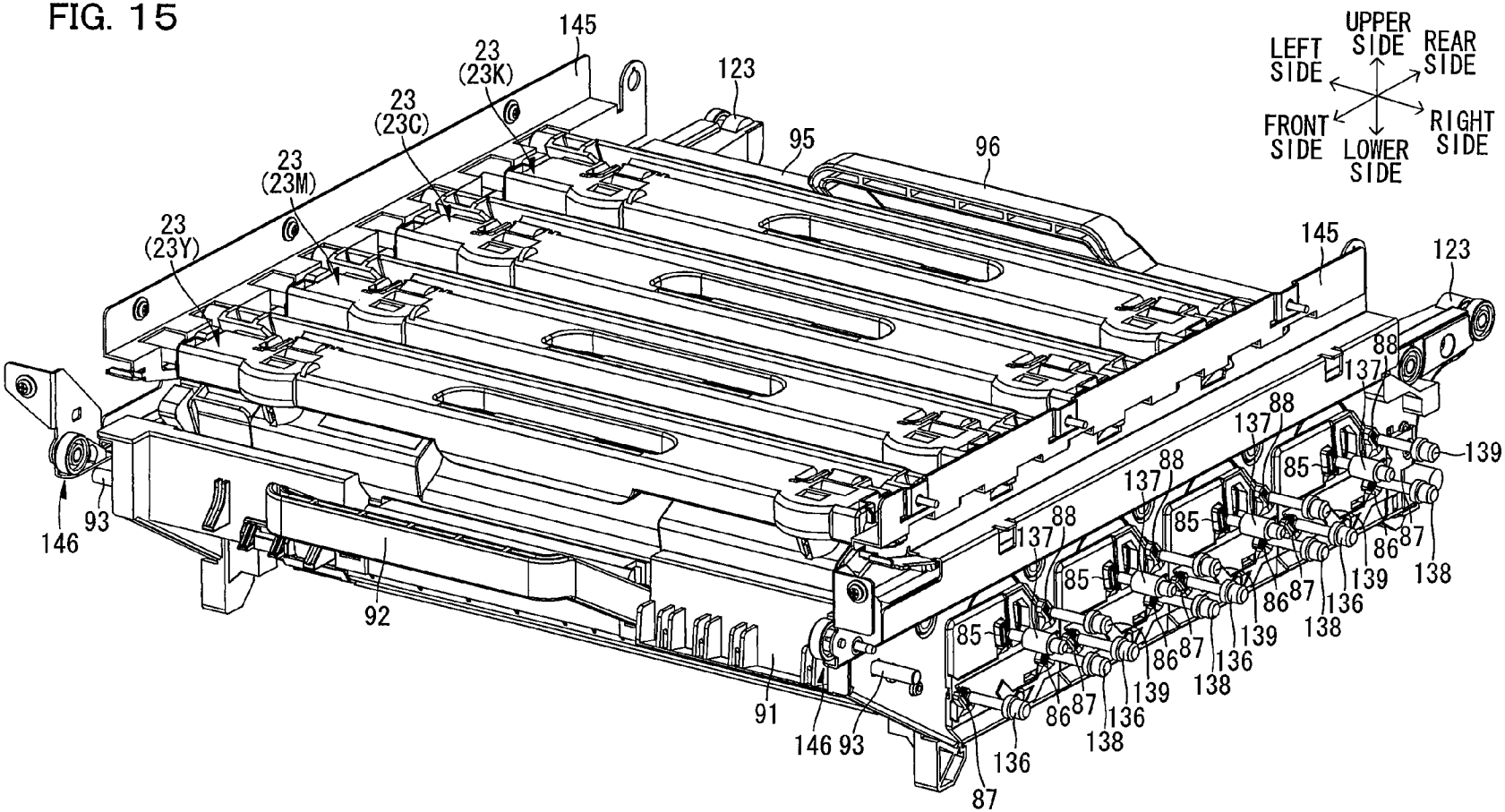
FIG. 15 is a perspective view of the main portion in FIG. 14.
Figure 16:
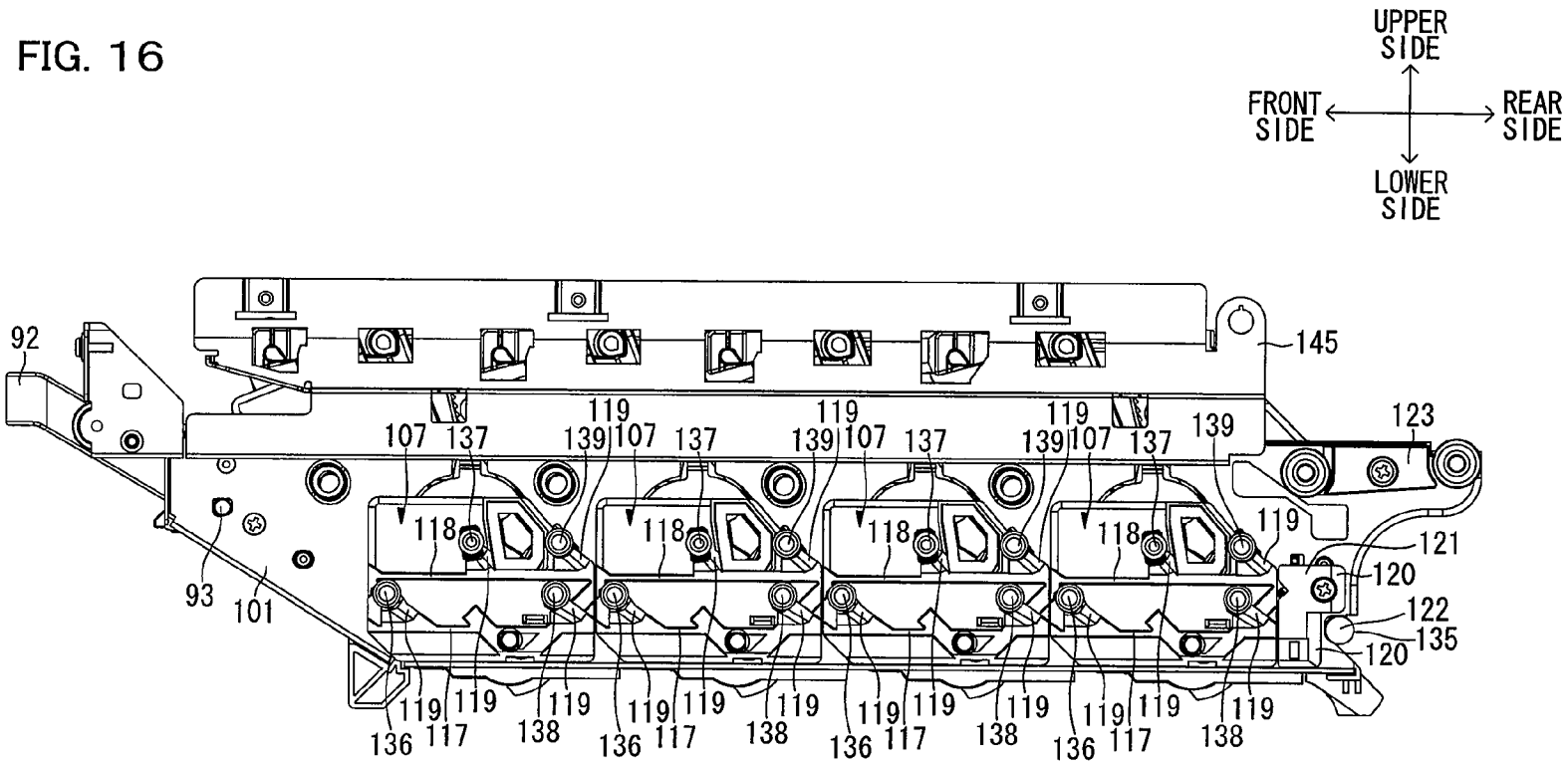
FIG. 16 is a right side view in FIG. 14.
Figure 17:
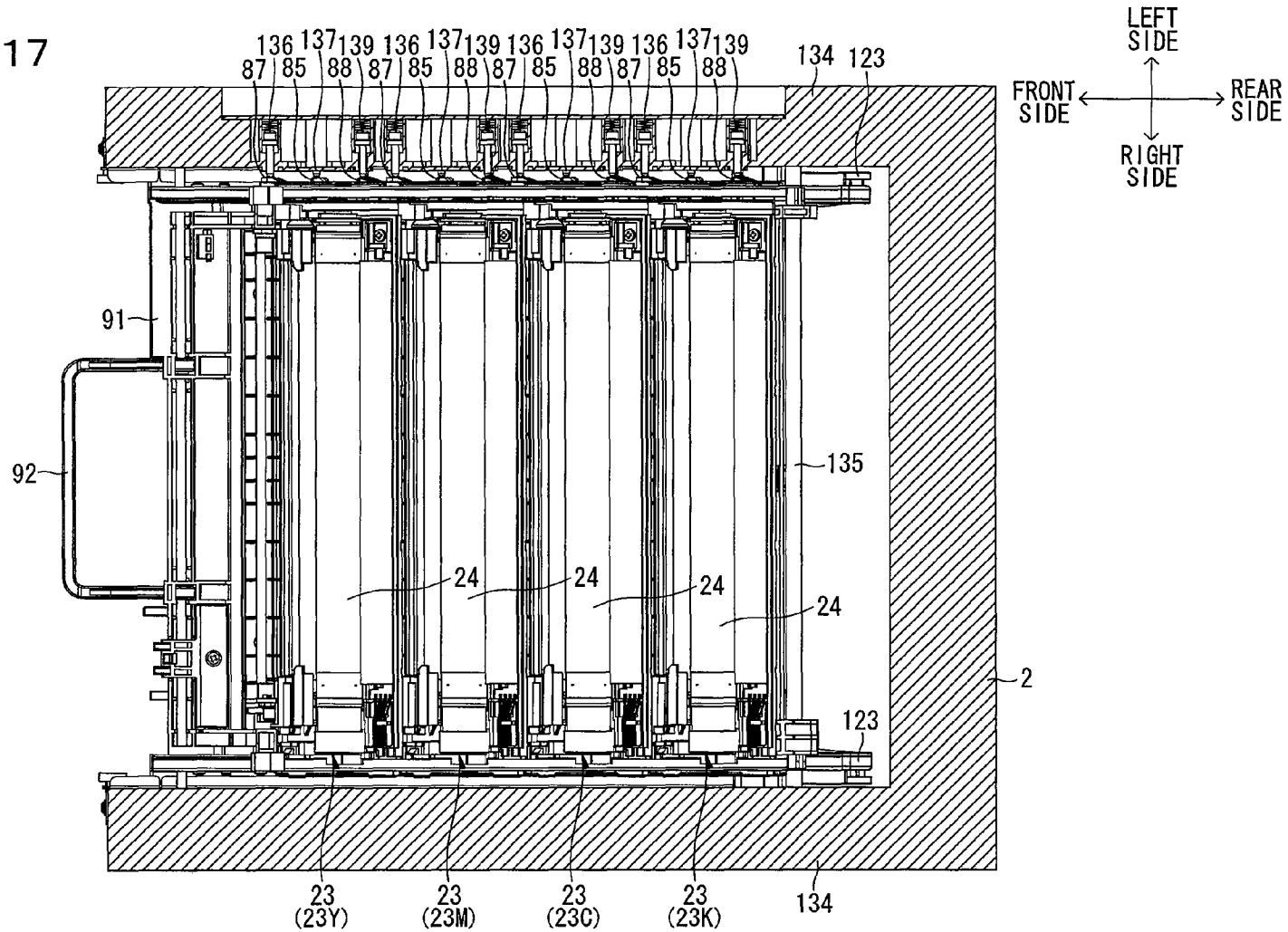
FIG. 17 is a bottom view in FIG. 14.

FIG. 7 is a perspective view showing a state in which the drum unit is mounted to a main body casing (the state after the start of mounting of the drum unit), FIG. 8 is a perspective view of the main portion in FIG. 7, FIG. 9 is a bottom view of the main portion in FIG. 7, and FIG. 10 is a bottom view in FIG. 7. Further, FIG. 11 is a perspective view showing a state in which the drum unit is mounted to a main body casing (the state before the completion of mounting of the drum unit), FIG. 12 is a perspective view of the main portion in FIG. 11, and FIG. 13 is a right side view in FIG. 11. Further, FIG. 14 is a perspective view showing a state in which the drum unit is mounted in a main body casing (the state after the completion of mounting of the drum unit), FIG. 15 is a perspective view of the main portion in FIG. 14, FIG. 16 is a right side view in FIG. 14, and FIG. 17 is a bottom view in FIG. 14.

Next, the main body casing 2 will be described with reference to FIG. 1 and FIGS. 7 through 17.

As shown in FIG. 1, the front cover 131 is provided in the front wall of the main body casing 2. The front cover 131 is provided so that its lower end portion is swingably supported by hinges etc. on the front wall of the main body casing 2, and that its upper end portion moves between the closed position where it abuts the upper wall of the main body casing 2 and an open position where it is spaced away from the upper wall of the main body casing 2.

When the front cover 131 is swung to the open position, the drum receiving section 133 in which the drum unit 21 is removably received is exposed from the drum mounting port 132 as an example of an opening port thereof.

As shown in FIG. 14, the main body casing 2 includes a pair of side wall portions 134 which are spaced in opposed relation to each other at both widthwise sides with the drum unit 21 interposed therebetween in the mounting state of the drum unit 21.

As shown in FIGS. 8 and 10, the main body casing 2 is provided in its rear end portion (downstream end portion in the mounting direction) with the reference shaft 135 to which the notched portion 112 of each side plate 101 of the drum unit 21 abuts. The reference shaft 135 is extended between the side wall portions 134 along the width direction, and fixed to lower rear end portions of the side wall portions 134.

Although detailed descriptions are omitted herein, as shown in FIG. 14, the main body casing 2 is provided with a pressing mechanism section 146 for pressing the support shaft 93 of the drum unit 21 at a front end portion (upstream end portion in the mounting direction) of each side wall portion 134.

The main body casing 2 is also provided with the guide rails 145 in which the flange portions 103 of the drum unit 21 are slidably received and the roller members 123 roll, at opposite positions of the respective side wall portions 134. Each guide rail 145 anteroposteriorly extends in each side wall portion 134.

As shown in FIG. 8, the main body casing 2 has on its right-side side wall portion 134 four groups each including the developing roller contact portion 136, the wire contact portion 137, the grid contact portion 138, and the cleaning contact portion 139 corresponding to each drum subunits 23.

The developing roller contact portion 136, the wire contact portion 137, the grid contact portion 138, and the cleaning contact portion 139 are opposed widthwise to the developing roller electrode 87, the wire electrode 85, the grid electrode 86, and the cleaning electrode 88, respectively, in each drum subunit 23 in the state where the drum unit 21 is mounted in the main body casing 2.

The wire contact portion 137 and the cleaning contact portion 139, and the grid contact portion 138 and the developing roller contact portion 136 are arranged in parallel at intervals in the up and down direction so that the wire contact portion 137 and the cleaning contact portion 139 are on the upper side and the grid contact portion 138 and the developing roller contact portion 136 are on the lower side.

More specifically, the grid contact portion 138 and the developing roller contact portion 136 in each drum subunit 23 are arranged on the same straight line along the front and rear direction (attachment/detachment direction) so as to slide on the lower flat surface 117 in the midway of the mounting of the drum unit 21 to the main body casing 2. Further, the cleaning contact portion 139 and the wire contact portion 137 are arranged on the same straight line along the front and rear direction (attachment/detachment direction) so as to slide on the upper flat surface 118 in the midway of the mounting of the drum unit 21 to the main body casing 2.

As shown in FIG. 10, each of the developing roller contact portions 136, wire contact portions 137, grid contact portions 138, and cleaning contact portions 139 integrally includes a head portion 140 of a large diameter provided on the widthwise outer side, and a shaft portion 141 of a small diameter extending from the head portion 140 inward in the width direction.

On the other hand, the right-side side wall portion 134 has contact portion accommodation sections 142 each having a sealed tubular shape and retreatably receiving the developing roller contact portion 136, the wire contact portion 137, the grid contact portion 138, and the cleaning contact portion 139 along the width direction. The contact portion accommodation section 142 slidably receives the head portion 140, while having on the widthwise inner side wall thereof a contact hole 143 which restricts the inward movement of the head portion 140 in the width direction and allows inward protrusion of the shaft portion 141 from the right-side side wall portion 134 in the width direction.

Each contact portion accommodation section 142 has a spring 144 inserted between the head portion 140 and the widthwise outer side wall of the contact portion accommodation section 142 for urging the head portion 140 inward in the width direction.

Each of the developing roller contact portions 136, wire contact portions 137, grid contact portions 138, and cleaning contact portions 139 is normally urged inward in the width direction (the inner direction of the opposite side of the side wall portion 134) by the spring 144, the head portion 140 abuts against the widthwise inner side wall of the contact portion accommodation section 142, and the shaft portion 141 is protruded from the right-side side wall portion 134 inward in the width direction.

4. Mounting of Drum Unit to Main Body Casing

As shown in FIG. 1, when the front cover 131 is swung to the open position, the drum receiving section 133 is exposed from the drum mounting port 132 of the main body casing 2. Thus, as shown in FIG. 7, the drum unit 21 is anteroposteriorly (horizontally) inserted into the drum receiving section 133 from the front side to the rear side, for example, by grasping the front-side grasp portion 92 of the drum unit 21, and then anteroposteriorly (horizontally) pushing the drum unit 21 rearwards.

In order to insert the drum unit 21 into the drum receiving section 133, as shown in FIG. 8, the roller members 123 provided in the rear end portions of the drum unit 21 are rolled on the respective guide rails 145 provided on both widthwise sides of the drum receiving section 133, and the flange portions 103 are inserted in the respective guide rails 145.

When the drum unit 21 is inserted into the drum receiving section 133, first, as shown in FIGS. 9 and 10, the lower developing roller contact portion 136 in the foremost end portion rides upon the lower mounting guide surface 120 so as to move outward in the width direction against the urging force of the spring 144. Next, the upper wire contact portion 137 in the foremost end portion rides upon the upper mounting guide surface 120 so as to move outward in the width direction against the urging force of the spring 144.

When the drum unit 21 is further inserted into the drum receiving section 133, the lower developing roller contact portion 136 in the foremost end portion slides on the lower flat surface 117 to maintain a widthwise fixed position. Then, the grid contact portion 138 rides upon the lower mounting guide surface 120 so as to move outward in the width direction against the urging force of the spring 144, and thereafter slides on the lower flat surface 117 to maintain a widthwise fixed position.

In addition, the upper wire contact portion 137 in the foremost end portion slides on the upper flat surface 118 to maintain a widthwise fixed position. Then, the cleaning contact portion 139 rides upon the upper mounting guide surface 120 so as to move outward in the width direction against the urging force of the spring 144, and thereafter slides on the upper flat surface 118 to maintain a widthwise fixed position.

As the insertion of the drum unit 21 into the drum receiving section 133 proceeds, in the same manner as described above, the developing roller contact portion 136 and the grid contact portion 138 corresponding to each drum subunit 23 sequentially ride upon the lower mounting guide surface 120, and thereafter, slide on the lower flat surface 117 to maintain a widthwise fixed position respectively. The wire contact portion 137 and the cleaning contact portions 139 corresponding to each drum subunit 23 sequentially ride upon the upper mounting guide surface 120, and thereafter, slide on the upper flat surface 118 to maintain a widthwise fixed position respectively.

As shown in FIGS. 11, 12, and 13, when each of the wire contact portions 137, grid contact portions 138, and cleaning contact portions 139 approaches a position branching from the lower flat surface 117 or the upper flat surface 118 to the corresponding guide surface 119, as shown in FIGS. 15 and 16, the roller members 123 protrude rearward from the respective guide rails 145, and as shown in FIG. 14, the drum unit 21 moves obliquely downwardly rearward with respect to the guide rails 145 by its own weight. Then, as shown in FIG. 17, each of the wire contact portions 137, grid contact portions 138, and cleaning contact portions 139 is guided from the lower flat surface 117 or the upper flat surface 118 along the corresponding guide surface 119 from the widthwise outer side to the widthwise inner side, and as shown in FIGS. 15 and 16, is connected to the corresponding developing roller electrode 87, wire electrode 85, grid electrode 86, or cleaning electrode 88, against the urging force of the spring 144.

Simultaneously, the notched portion 122 of each side plate 101 of the drum unit 21 abuts to clamp the reference shaft 135, while the support shaft 93 of the drum unit 21 is pressed by the pressing mechanism members 146. Thus, the mounting of the drum unit 21 to the main body casing 2 is completed. After the completion of the mounting of the drum unit 21 to the main body casing 2, the front cover 131 is swung to the closed position to close the drum mounting port 132 of the main body casing 2.

When the drum unit 21 is detached from the main body casing 2, for example, the front cover 131 is swung to the open position to expose the drum unit 21 from the drum mounting port 132 of the main body casing 2, and then, for example, the front-side grasp portion 92 of the drum unit 21 is grasped to draw the drum unit 21 anteroposteriorly (horizontally) forward. Then, in a reversed manner of those described above, each of the wire contact portions 137, grid contact portions 138, and cleaning contact portions 139 is guided from the widthwise outer side to the widthwise inner side along the corresponding guide surface 119, and thereafter, slides on the lower flat surface 117 or the upper flat surface 118 to maintain a widthwise fixed position, and then is detached from the mounting guide surface 121.

6. Operational Effects of Present Embodiments

In the color laser printer 1, as described above, during the attachment/detachment of the drum unit 21 to/from the drum receiving section 133, each of the developing roller contact portions 136, wire contact portions 137, grid contact portions 138, and cleaning contact portions 139 that are urged inward in the width direction from the right-side side wall portion 134 of the main body casing 2 slidably contacts the lower flat surface 117 or the upper flat surface 118 in the drum unit 21, so that the widthwise position of each of the developing roller contact portions 136, wire contact portions 137, grid contact portions 138, and cleaning contact portions 139 that are urged inward in the width direction from the right-side side wall portion 134 of the main body casing 2 is maintained constant.

On the other hand, each of the developing roller electrodes 87, wire electrodes 85, grid electrodes 86, and cleaning electrodes 88 that protrudes outward in the width direction in the drum unit 21 is arranged outward in the width direction above the corresponding lower flat surface 117 or the upper flat surface 118. Therefore, during the attachment/detachment of the drum unit 21 to/from the drum receiving section 133, each of the developing roller contact portions 136, wire contact portions 137, grid contact portions 138, and cleaning contact portions 139 is prevented from interfering with an electrode other than the corresponding developing roller electrode 87, wire electrode 85, grid electrode 86, or cleaning electrode 88.

As a result, even though a construction in which the developing roller contact portions 136, the wire contact portions 137, the grid contact portions 138 and the cleaning contact portions 139 advance after mounting of the drum unit 21 and retreat during removal of the drum unit 21, each of the developing roller contact portions 136 is not adopted, the wire contact portions 137, the grid contact portions 138 and the cleaning contact portions 139 can be securely connected to the corresponding developing roller electrode 87, wire electrode 85, grid electrode 86, or cleaning electrode 88, in a simple construction.

Further, in the color laser printer 1, during the attachment/detachment of the drum unit 21 to/from the drum receiving section 133, the developing roller contact portion 136, the wire contact portion 137, the grid contact portion 138, and the cleaning contact portion 139 sequentially ride upon the mounting guide surface 120, and are then smoothly guided to the corresponding lower flat surface 117 and upper flat surface 118 along the mounting guide surface 120. Therefore, the developing roller contact portions 136, the wire contact portions 137, the grid contact portions 138, and the cleaning contact portions 139 can smoothly and securely contact the lower flat surfaces 117 and the upper flat surfaces 118 of the drum unit 21.

Further, in the color laser printer 1, the flat surface 116 of the guide path 115 includes the lower flat surface 117 and the upper flat surface 118 that are arranged in parallel to each other at an interval in the up and down direction, and the developing roller contact portion 136 and the grid contact portion 138 are aligned so as to slidably contact the lower flat surface 117, and the wire contact portion 137 and the cleaning contact portion 139 are aligned so as to slidably contact the upper flat surface 118.

Therefore, a plurality of the developing roller contact portions 136, wire contact portions 137, grid contact portions 138, and cleaning contact portions 139 are efficiently arranged in the drum unit 21, so that those contact portions can simply and securely contact the corresponding lower flat surfaces 117 and upper flat surfaces 118.

Further, in the color laser printer 1, during the mounting of the drum unit 21 to the drum receiving section 133, when each of the developing roller contact portions 136, wire contact portions 137, grid contact portions 138, and cleaning contact portions 139 passes the corresponding lower flat surface 117 or upper flat surface 118 in the drum unit 21 and thereafter, approaches the position branching toward the corresponding guide surface 119, the roller members 123 protrude rearward from the respective guide rail 145, so that the drum unit 21 moves obliquely rearward by its own weight with respect to the guide rails 145. Then, each of the developing roller contact portions 136, wire contact portions 137, grid contact portions 138, and cleaning contact portions 139 is guided along the corresponding guide surface 119 to be connected to the corresponding developing roller electrode 87, wire electrode 85, grid electrode 86, or cleaning electrode 88. This achieves secure connection of those contacts with those corresponding electrodes.

Furthermore, since the guide surfaces 119 incline from the corresponding lower flat surfaces 117 and upper flat surfaces 118 outward in the width direction, each of the developing roller contact portions 136, wire contact portions 137, grid contact portions 138, and cleaning contact portions 139 is guided from its widthwise fixed position that is maintained by the lower flat surface 117 or upper flat surface 118 to the widthwise outer side by each guide surface 119.

For this reason, when each of the developing roller contact portions 136, wire contact portions 137, grid contact portions 138, and cleaning contact portions 139 is connected to the corresponding developing roller electrodes 87, wire electrodes 85, grid electrodes 86, and cleaning electrodes 88, a reaction force to the urging force of the spring 144 in each of the developing roller contact portions 136, wire contact portions 137, grid contact portions 138, and cleaning contact portions 139 becomes larger. This achieves more secure connection of those contacts with the corresponding electrodes.

Each of the developing roller electrodes 87, wire electrodes 85, grid electrodes 86, and cleaning electrodes 88 is arranged above the lower flat surfaces 117 or upper flat surfaces 118 for guiding the corresponding developing roller contact portions 136, wire contact portions 137, grid contact portions 138, and cleaning contact portions 139. Therefore, when the roller members 123 protrude rearward from the respective guide rails 145 to move the drum unit 21 obliquely rearward with respect to the guide rails 145 by its own weight, each of the developing roller contact portions 136, wire contact portions 137, grid contact portions 138, and cleaning contact portions 139 is guided along the corresponding guide surface 119 to be connected to the corresponding developing roller electrode 87, wire electrode 85, grid electrode 86, or cleaning electrode 88. This achieves secure connection of those contacts with those corresponding electrodes by a simple operation.

The color laser printer 1 ensures that each of the developing roller electrodes 87, wire electrodes 85, grid electrodes 86, and cleaning electrodes 88 provided corresponding to each drum subunit 23 is connected to the corresponding developing roller contact portion 136, wire contact portion 137, grid contact portion 138, or cleaning contact portion 139. This results in improvement in reliability of the color laser printer 1.

7. Variations

In the embodiment described above, the lower flat surface 117 and the upper flat surface 118 are formed so as to anteroposteriorly linearly pass through the seal members 107. However, if it is possible to maintain constant widthwise positions at required portions, all the flat surfaces of the guide path of one or more aspects of the present invention may not be formed so as to anteroposteriorly linearly pass through.

Figure 18:
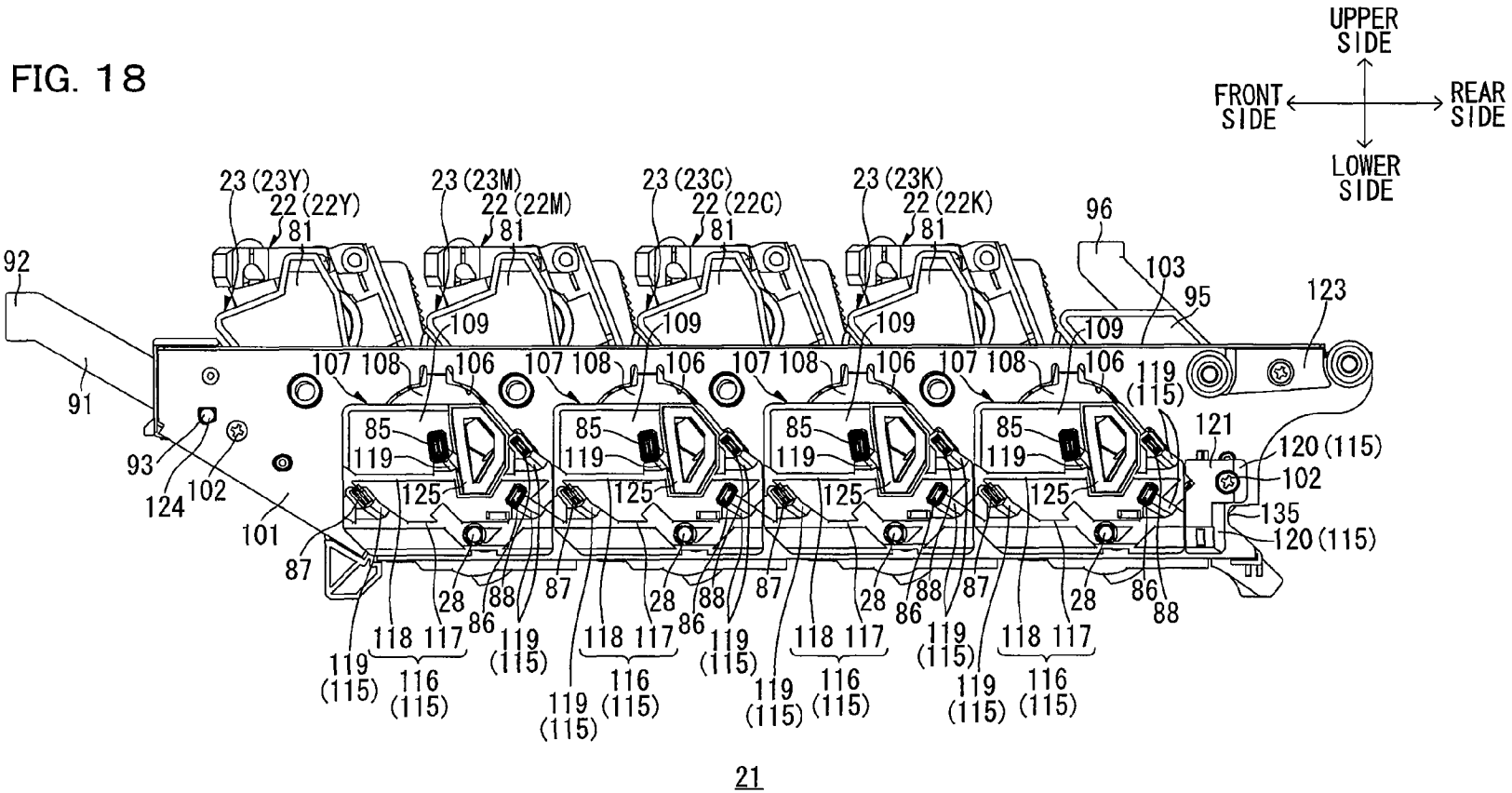
FIG. 18 is a right side view of a drum unit showing another embodiment corresponding to FIG. 6.

For example, as shown in FIG. 18, the seal frame portion 125 described above on each seal member 107 may be further extended downward to be interposed in the midway of the upper flat surface 118. In this case, an inclined surface that inclines from the rear side to the front side and from the widthwise inner side to the widthwise outer side is formed in a rear end portion of the seal frame portion 125 with which the upper flat surface 118 is continuous, and an inclined surface that inclines from the rear side to the front side and from the widthwise outer side to the widthwise inner side is formed in a front end portion of the seal frame portion 125 with which the upper flat surface 118 is continuous. This allows the wire contact portion 137 and the cleaning contact portion 139 to smoothly pass through the seal frame portion 125 in the midway of the upper flat surface 118.

The drum unit 21 in the embodiment described above is provided with the developer cartridge 22 for each color as a separate body from the drum subunit 23 so that the developer cartridge 22 is removably mounted in the drum subunit 23 for a corresponding color. However, it is possible to integrally form the developer cartridge 22 and the drum subunit 23. In this case, replacement of the drum unit 21 enables replacement of a toner for each color, a developing roller 34, and a photosensitive drum 24 at a time.

In the embodiment described above, there is illustrated the color laser printer 1 of the tandem type for direct transfer onto a sheet 3 from each photosensitive drum 24. However, one or more aspects of the present invention is not limited thereto, and for example, may be constructed as a color laser printer of an intermediate transfer type for temporarily transferring color toner images from respective photosensitive members onto an intermediate transfer body, and then transferring the overlapped images onto a sheet at once.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

an apparatus body having a unit receiving section, and a photosensitive-member unit retaining a plurality of photosensitive members, the photosensitive-member unit configured to be slidable with respect to the apparatus body between a first position at which the photosensitive-member unit is received by the unit receiving section and a second position at which the photosensitive-member unit is away from the unit receiving section, and wherein the apparatus body comprises side wall portions opposing each other with the unit receiving section sandwiched therebetween, a plurality of first apparatus-body-side electrode members that is provided on at least one of the side wall portions in correspondence with the plurality of photosensitive members, the plurality of first apparatus-body-side electrode members arranged in line along a sliding direction of the photosensitive-member unit, and a plurality of second apparatus-body-side electrode members that is provided on at least one of the side wall portions in correspondence with the plurality of the photosensitive members, the plurality of second apparatus-body-side electrode members arranged in line along the sliding direction of the photosensitive-member unit and below the plurality of first apparatus-body-side electrode members;

the photosensitive-member unit comprises a plurality of first unit-side electrode members corresponding to the plurality of first apparatus-body-side electrode members, respectively, and connected to the respective first apparatus-body-side electrode members when the photosensitive-member unit is mounted in the unit receiving section, and a plurality of second unit-side electrode members corresponding to the plurality of second apparatus-body-side electrode members, respectively, and connected to the respective second apparatus-body-side electrode members when the photosensitive-member unit is mounted in the unit receiving section;

the plurality of first-unit-side electrode members is configured so as to pass through above the plurality of first-apparatus-body-side electrode members when the photosensitive-member unit moves from the second position to the first position; and the plurality of second-unit-side electrode members is configured so as to pass through between the plurality of first-apparatus-body-side electrode members and the plurality of second apparatus-body-side electrode members when the photosensitive-member unit moves from the second position to the first position.

2. The image forming apparatus according to claim 1, wherein the plurality of first-apparatus-body-side electrode members and the plurality of second-apparatus-body-side electrode members are configured so as to urge inward in an opposing direction of the side wall portions.

3. The image forming apparatus according to claim 2, wherein the plurality of first-unit-side electrode members and the plurality of second-unit-side electrode members are configured so as to protrude outward in an opposing direction of the side wall portions.

4. The image forming apparatus according to claim 3, wherein the plurality of first and second-unit-side electrode members and the plurality of first and second-apparatus-body-side electrode members are configured so as to partially overlap with each other when viewed from the direction perpendicular to both of the sliding direction of the photosensitive-member unit and the opposing direction of the side wall portions when the photosensitive-member unit moves from the second position to the first position.

5. The image forming apparatus according to claim 4, wherein the photosensitive-member unit further comprises a first guide path comprising a flat surface formed in a flat shape so that the plurality of first apparatus-body-side electrode members slidably contact to the flat surface, and that the plurality of first apparatus-body-side electrode members slidably contacted maintains a constant contact at an inward and outward position in the opposing direction when the photosensitive-member unit moves from the second position to the first position, and a second guide path comprising a flat surface formed in a flat shape so that the plurality of second apparatus-body-side electrode members slidably contacts the flat surface, and that the plurality of second apparatus-body-side electrode members slidably contacted maintains a constant contact at an inward and outward position in the opposing direction when the photosensitive-member unit moves from the second position to the first position.

6. The image forming apparatus according to claim 5, wherein the first and second guide path comprise a mounting guide surface inclining outward from an inside position in the opposing direction on a most downstream side in a mounting direction of the photosensitive-member unit to the unit receiving section.

7. The image forming apparatus according to claim 5 wherein the first guide path and the second guide path comprise guide surfaces formed on a downstream side of each of the first unit-side electrode members and the second unit-side electrode members in a mounting direction of the photosensitive-member unit to the unit receiving section, extending from the flat surface in a direction intersecting the mounting direction, and guiding each of the first apparatus-body-side electrode members and the second apparatus-body-side electrode members to each of the corresponding first unit-side electrode members and the second unit-side electrode members.

8. The image forming apparatus according to claim 6, wherein the mounting guide surface inclines outward in the opposing direction from the flat surface toward the upstream side in the mounting direction.

9. The image forming apparatus according to claim 1, wherein the first-unit-side electrode members are wire electrodes or cleaning electrodes.

10. The image forming apparatus according to claim 1, wherein the second unit-side electrode members are grid electrodes or developing roller electrodes.

11. The image forming apparatus according to claim 1, wherein the first-unit-side electrode members are cleaning electrodes, and the second-unit-side electrode members are developing roller electrodes.

* * * * *

UNITED STATES PATENT AND TRADEMARK OFFICE

CERTIFICATE OF CORRECTION

PATENT NO. : 7,890,013 B2
APPLICATION NO. : 12/749827
DATED : February 15, 2011
INVENTOR(S) : Yasushi Okabe It is certified that error appears in the above-identified patent and that said Letters Patent is hereby corrected as shown below:

IN THE CLAIMS:

In Column 22, Claim 1, Lines 5 and 10:
Please delete “through”

In Column 22, Claim 5, Line 39:
Please replace “contact to” with --contacts--

In Column 22, Claim 6, Line 54:
Please replace “path” with --paths--

Signed and Sealed this
Twentieth Day of September, 2011

David J. Kappos

David J. Kappos
*Director of the United States Patent and Trademark Office*